US010654673B2

(12) United States Patent
Yamashita

(10) Patent No.: US 10,654,673 B2
(45) Date of Patent: May 19, 2020

(54) IMAGE FORMING APPARATUS AND METHOD FOR CONTROLLING IMAGE FORMING APPARATUS

(71) Applicant: KYOCERA Document Solutions Inc., Osaka (JP)

(72) Inventor: Keisuke Yamashita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 16 days.

(21) Appl. No.: 16/249,557

(22) Filed: Jan. 16, 2019

(65) Prior Publication Data

US 2019/0256308 A1 Aug. 22, 2019

(30) Foreign Application Priority Data

Feb. 22, 2018 (JP) ..... 2018-029472

(51) Int. Cl.

| | |
|---|---|
| ***B65H 1/14*** | (2006.01) |
| ***B65H 7/04*** | (2006.01) |
| ***B65H 3/06*** | (2006.01) |
| ***B65H 1/26*** | (2006.01) |

(52) U.S. Cl.

CPC ..... *B65H 7/04* (2013.01); *B65H 1/266* (2013.01); *B65H 3/06* (2013.01)

(58) Field of Classification Search

CPC .... B65H 1/14; B65H 2405/1117; B65H 7/04; B65H 1/266; B65H 3/06

USPC ..... 271/127, 152, 153, 155

See application file for complete search history.

(56) References Cited

U.S. PATENT DOCUMENTS

| | | | | |
|---|---|---|---|---|
| 2011/0101600 | A1* | 5/2011 | Chihara | B65H 1/14 271/152 |
| 2014/0312557 | A1* | 10/2014 | Ishikawa | B65H 3/54 271/18.1 |
| 2015/0368056 | A1* | 12/2015 | Murata | B65H 7/04 271/259 |
| 2017/0315491 | A1* | 11/2017 | Kawamura | B65H 7/02 |
| 2017/0357199 | A1* | 12/2017 | Minamino | B65H 1/266 |

FOREIGN PATENT DOCUMENTS

JP 2000-307786 A 11/2000

* cited by examiner

*Primary Examiner* — David H Bollinger

(74) *Attorney, Agent, or Firm* — Stein IP, LLC

(57) ABSTRACT

A controller recognizes a remaining level of sheets in a sheet feeding cassette. The controller counts the required time after a sheet feeding rotary member starts to rotate until a sheet feeding sensor senses the tip end of a sheet. The controller judges whether a sheet feeding delay has occurred based on the required time. The controller calculates the incidence of sheet feeding delays for each sheet remaining level.

12 Claims, 10 Drawing Sheets

| REMAINING LEVEL | FIRST SENSOR | SECOND SENSOR |
|---|---|---|
| LEVEL 4 (75%<X≦100%) | LIGHT TRANSMITTED | LIGHT TRANSMITTED |
| LEVEL 3 (50%<X≦75%) | LIGHT SHIELDED | LIGHT TRANSMITTED |
| LEVEL 2 (25%<X≦50%) | LIGHT SHIELDED | LIGHT SHIELDED |
| LEVEL 1 (0%<X≦25%) | LIGHT TRANSMITTED | LIGHT SHIELDED |

D1

| REMAINING LEVEL | CUMULATIVE NUMBER OF FED SHEETS | NUMBER OF SHEETS WHOSE SHEET FEEDING DELAYED | INCIDENCE OF SHEET FEEDING DELAYS |
|---|---|---|---|
| LEVEL 4 (75%<X≦100%) | X1 | Y1 | Z1 |
| LEVEL 3 (50%<X≦75%) | X2 | Y2 | Z2 |
| LEVEL 2 (25%<X≦50%) | X3 | Y3 | Z3 |
| LEVEL 1 (0%<X≦25%) | X4 | Y4 | Z4 |
| 計 | X5 | Y5 | Z5 |

IMAGE FORMING APPARATUS AND METHOD FOR CONTROLLING IMAGE FORMING APPARATUS

INCORPORATION BY REFERENCE

This application is based upon and claims the benefit of priority from the corresponding Japanese Patent Application No. 2018-029472 filed on Feb. 22, 2018, the contents of which are hereby incorporated by reference.

BACKGROUND

The present disclosure relates to an image forming apparatus which includes a sheet feeding portion for feeding sheets used for printing.

There are image forming apparatuses such as printers, multifunction peripherals, copiers and facsimile machines. The image forming apparatus stores sheets used for printing. For example, sheets for printing are set in a sheet cassette. Also, a roller for sending out (feeding) set sheets is provided. The roller wears as it is used. As wear advances, slipping becomes increasingly likely to occur. Slipping may cause a sheet feeding delay. When a slip so severe as to cause sheet feeding failure occurs, it is judged that a non-feed jam error has occurred. It is preferable to keep watch on the status of the roller so that the roller can be replaced before sheet feeding delays and errors frequently occur. There is one known example of a technology, as described below, which is related to watching the status of a machine.

Specifically, in a known image forming apparatus, an actual printing sheet arrival time sensed by a timing sensor provided on a sheet conveying path and a prescribed set time are compared with each other to judge conveyance quality; a deterioration judgement setting time calculated by subtracting from a setting time a minute time and the actual printing sheet arrival time are subjected to comparative judgement, and this comparative judgement is performed a prescribed number of times to count the number of times when the actual printing sheet arrival time is equal to or longer than the deterioration judgement setting time; when the number of times exceeds a prescribed number of times of judgement, warning information is displayed or is conveyed to a remote diagnosis system via, for example, a telephone line.

The sheet feeding roller makes contact with a sheet. The sheet feeding roller rotates to send out a sheet. That is, sheet feeding is performed using friction between a sheet and the roller that touches the sheet. Every time a sheet is fed, friction between the roller and a sheet recurs. Thus, the sheet feeding roller gradually wears. As the sheet feeding roller wears, the diameter of the roller decreases. As the period of use becomes longer, basically the friction force of the sheet feeding roller becomes smaller. While being used, the sheet feeding roller becomes increasingly prone to slip. The sheet feeding ability of the sheet feeding roller gradually lowers. As a result, the occurrence of sheet feeding delays increases.

Here, the behavior of sheets during sheet feeding changes depending on the remaining quantity of sheets. For example, depending on the remaining quantity of sheets, how sheets make contact with the sheet feeding roller (the state of contact) changes. When the remaining quantity of sheets is small, the sheets may need to be pulled up further than when the remaining quantity of sheets is large. Depending on the remaining quantity of sheets, the approach angle of sheets to a conveying member that follows the sheet feeding roller may change. As mentioned above, there is a problem that how likely sheet feeding delays are to occur is different depending on the remaining quantity of sheets. For example, when the remaining quantity of sheets is 5%, sheet feeding delays are more likely to occur than when it is 100%.

In the known technology mentioned above, the state of the roller is watched with no consideration given to the remaining quantity of sheets. Thus, it is not possible to solve the problem mentioned above.

SUMMARY

An image forming apparatus according to the present disclosure includes a notification portion, a sheet feeding cassette, a sheet feeding rotary member, a sheet feeding sensor, a remaining quantity sensor, a storage portion, and a controller. The notification portion performs notification. The sheet feeding cassette includes a placing plate on which sheets are set. The sheet feeding rotary member is provided above the sheet feeding cassette, and feeds sheets by rotating. The sheet feeding sensor is provided on the downstream side of the sheet feeding rotary member in the sheet conveying direction to sense the arrival and the passage of sheets. The remaining quantity sensor is for sensing the remaining quantity of sheets in the sheet feeding cassette. The storage portion stores notification data. The controller recognizes the remaining level of sheets in the sheet feeding cassette based on the output of the remaining quantity sensor. The controller raises the placing plate according to the remaining quantity of sheets such that the sheet feeding rotary member and the sheets make contact with each other. The controller counts the required time after the sheet feeding rotary member starts to rotate until the sheet feeding sensor senses the tip end of a sheet. The controller judges whether a sheet feeding delay has occurred based on the required time. The controller makes the storage portion store the cumulative number of fed sheets for each remaining level and the number of sheets whose sheet feeding has delayed for each remaining level as the notification data. The controller calculates an incidence of sheet feeding delays for each remaining level based on the notification data. The controller makes the notification portion notify the remaining level at which the incidence exceeds the first threshold value.

This and other characteristics of the present disclosure, and the specific benefits obtained according to the present disclosure, will become apparent from the description of embodiments which follows.

DETAILED DESCRIPTION

The present disclosure relates to determining the incidence of sheet feeding delays for different remaining levels of sheets. The present disclosure relates to giving a notification according to a remaining level. Hereinafter, with reference to FIGS. 1 to 18, an embodiment of the present disclosure will be described. It should however be noted that all the features described in connection with the embodiment in terms of structures, arrangements, and the like are merely examples and are not meant to limit the scope of the disclosure.

Image Forming Apparatus 100

Figure 1:
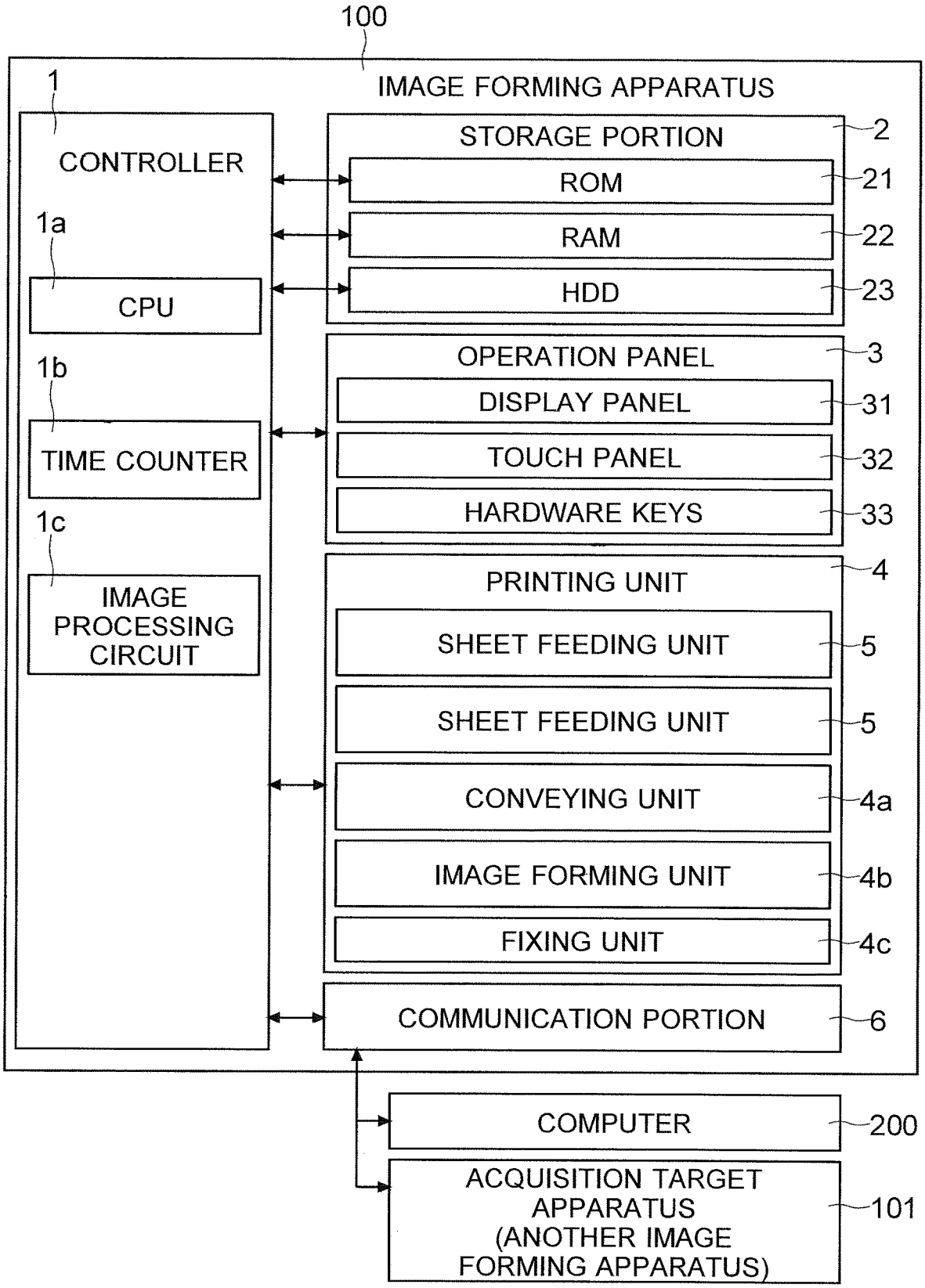
FIG. 1 is a diagram showing one example of an image forming apparatus according to an embodiment.

Next, based on FIG. 1, one example of an image forming apparatus 100 according to the embodiment will be described. Here, a printer is taken as an example of the image forming apparatus 100. The image forming apparatus 100 may be a multifunction peripheral. The image forming apparatus 100 may be any printing device other than a printer or a multifunction peripheral.

The image forming apparatus 100 includes a controller 1. The controller 1 controls the operation of the image forming apparatus 100. The controller 1 is a circuit board including a CPU 1*a*, a time counter 1*b*, and an image processing circuit 1*c*. The CPU 1*a* is an integrated circuit for performing control and calculation with respect to the image forming apparatus 100. The CPU 1*a* performs control of different portions of the image forming apparatus 100 and different kinds of calculation based on programs and data stored in a storage portion 2. The time counter 1*b* is a circuit for counting time. Instead of the time counter 1*b*, the CPU may count time.

Based on print job data received from a computer 200, the image processing circuit 1*c* generates image data used for printing. Print job data includes data written in a page description language. The image processing circuit 1*c* generates image data from data written in a page description language. Also, based on setting data included in print job data, according to a setting made on the computer 200, the image processing circuit 1*c* performs image processing on image data. The image processing circuit 1*c* performs image processing such as density conversion, enlargement, and reduction.

The storage portion 2 includes ROM 21, RAM 22, and a HDD 23. The storage portion 2 stores data of the image forming apparatus 100 (for example, setting data for control and image data) and programs for control.

The image forming apparatus 100 includes an operation panel 3. The operation panel 3 includes a display panel 31 (corresponding to a notification portion), a touch panel 32, and hardware keys 33. The controller 1 makes the display panel 31 display various setting screens and operation images. The operation images include, for example, buttons, keys, and tabs. The controller 1 makes the display panel 31 display notifications to a user. The display panel 31 is fitted with the touch panel 32. The touch panel 32 senses the touched position. Based on the output from the touch panel 32, the controller 1 recognizes the operation images that have been operated.

The image forming apparatus 100 includes a printing unit 4. The printing unit 4 includes a sheet feeding unit 5, a conveying unit 4*a*, an image forming unit 4*b*, and a fixing unit 4*c*. The image forming apparatus 100 includes a plurality of sheet feeding portions 5. The controller 1 controls the operation of the sheet feeding unit 5, the conveying unit 4*a*, the image forming unit 4*b*, and the fixing unit 4*c*. The controller 1 controls printing-related processing such as sheet feeding, sheet conveyance, toner image formation, transferring, and fixing. During a printing job, the controller 1 makes one of the sheet feeding portions 5 feed sheets one after another. The controller 1 makes the conveying unit 4*a* convey the fed sheet. The controller 1 makes the image forming unit 4*b* form a toner image based on image data. The controller 1 makes the image forming unit 4*b* transfer a toner image to the conveyed sheet. The controller 1 makes the fixing unit 4*c* fix the toner image on the sheet. The conveying unit 4*a* discharges the sheet having undergone fixing to outside the apparatus. The printed sheet is discharged to a discharge tray (unillustrated).

The image forming apparatus 100 includes a communication portion 6 (corresponding to the notification portion). The communication portion 6 is provided with different types of communication sockets, a communication circuit, and communication software. The communication portion 6 communicates with the computer 200 such as a PC or a server via a network. The communication portion 6 receives print job data transmitted from the computer 200. The controller 1 makes the printing unit 4 perform printing based on the received print job data. The communication portion 6 can communicate with other image forming apparatuses via a network.

Sheet Feeding Unit 5

Figure 2:
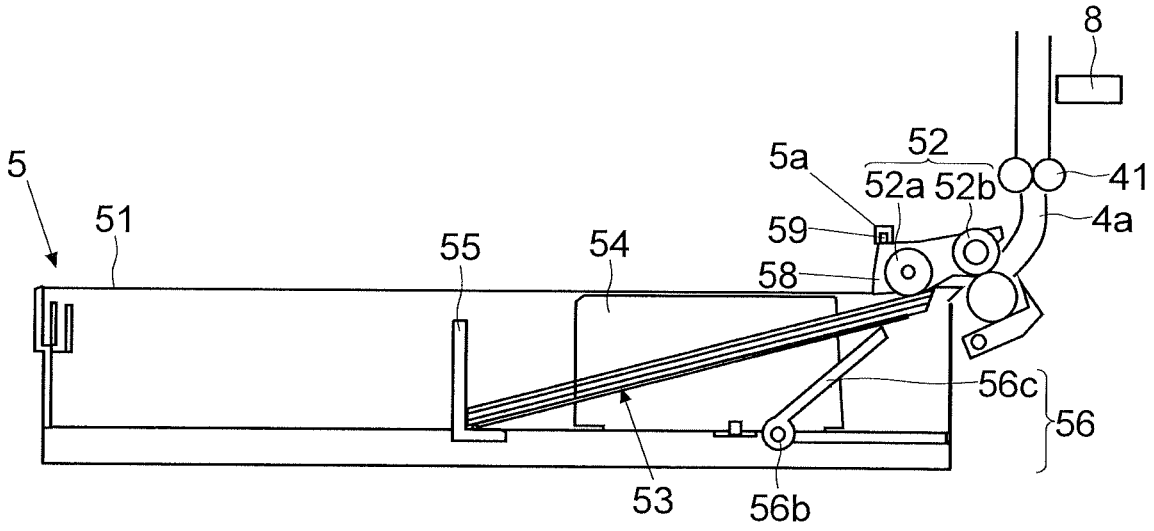
FIG. 2 is a diagram showing one example of a sheet feeding portion according to the embodiment.
Figure 3:
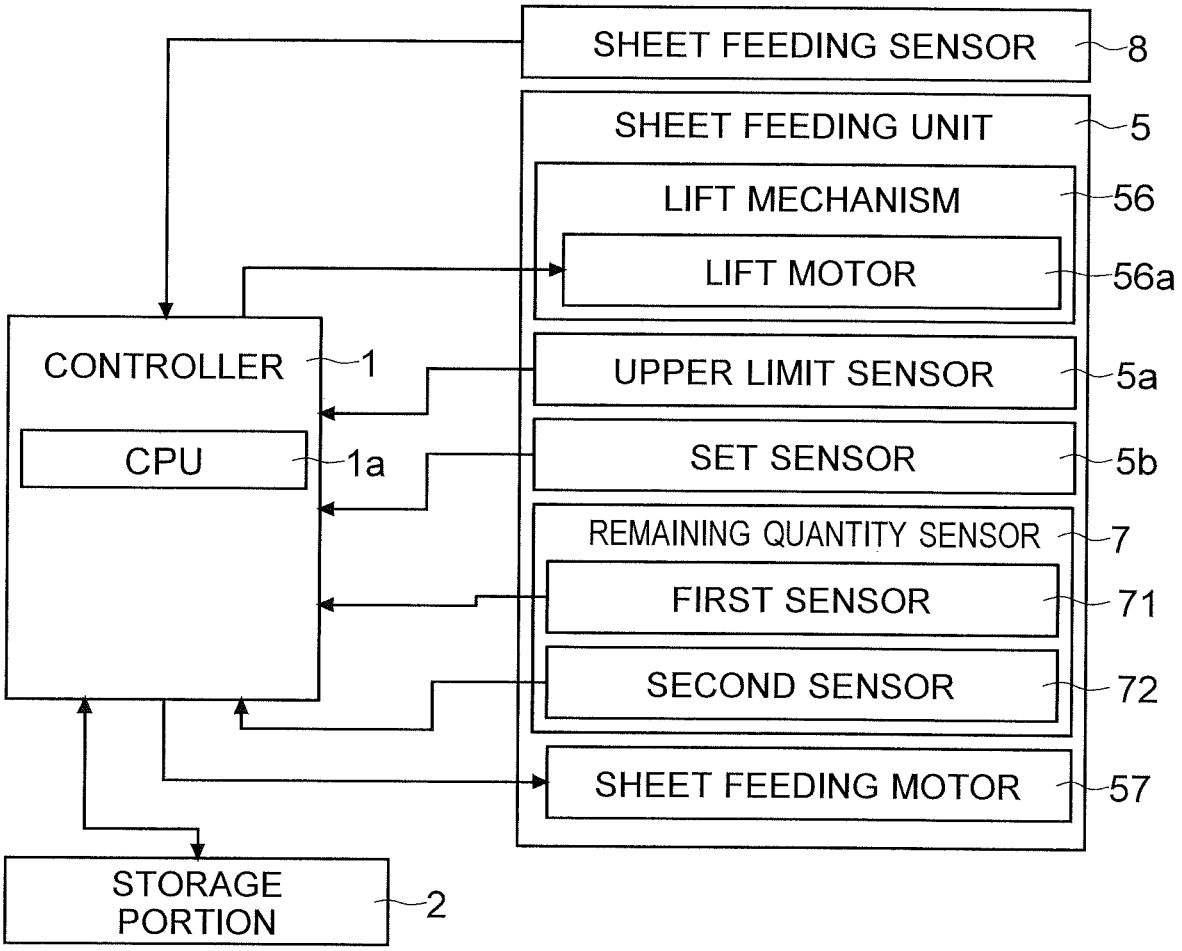
FIG. 3 is a diagram showing one example of the sheet feeding portion according to the embodiment.
Figure 4:
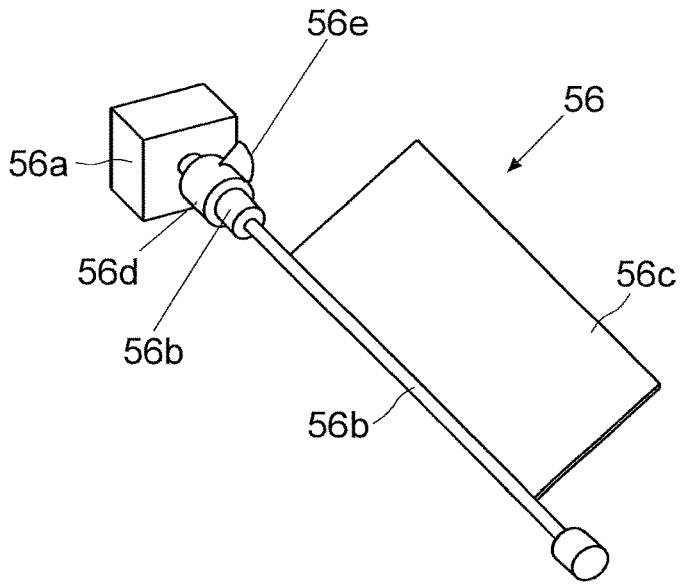
FIG. 4 is a diagram showing one example of a lift mechanism according to the embodiment.

Next, with reference to FIGS. 2 to 4, the sheet feeding unit 5 according to the embodiment will be described. The image forming apparatus 100 includes a plurality of sheet feeding portions 5. All the sheet feeding portions 5 have a similar structure. Thus, for convenience, one of the sheet feeding portions 5 will be described below. In FIGS. 2 to 4, one of the sheet feeding portions 5 is illustrated. The description of one sheet feeding unit 5 applies equally to the other sheet feeding portions 5.

The sheet feeding unit 5 stores a plurality of sheets (a bundle of sheets). The sheet feeding unit 5 sends out sheets one after another. The sheet feeding unit 5 includes a sheet feeding cassette 51 and a sheet feeding rotary member 52. The sheet feeding cassette 51 can be pulled out from the image forming apparatus 100. With the sheet feeding cassette 51 pulled out, it is possible to replenishment sheets or to change sheets that are set.

The sheet feeding cassette 51 includes a placing plate 53, a width regulation cursor pair 54 (only one of the pair can be seen in FIG. 2), and a rear end regulation cursor 55. Sheets (a bundle of sheets) are set on the placing plate 53. The placing plate 53 is pivotable in the up-down direction. A pivot shaft is provided in an upstream-side end part (a left-side end part in FIG. 2) of the placing plate 53. A downstream-side end part (a right-side end part in FIG. 2) of the placing plate 53 is a free end.

The width regulation cursor pair 54 can be slid in the direction perpendicular to the conveying direction. Each regulation cursor of the width regulation cursor pair 54 moves in coordination with the other. The width regulation cursors make contact with the set sheets to regulate their position. The rear end regulation cursor 55 can be slid along the conveying direction. The rear end regulation cursor 55 makes contact with the set sheets. The rear end regulation cursor 55 regulates the rear end position of the sheets.

A lift mechanism 56 is provided below the downstream-side end part of the placing plate 53. The lift mechanism 56 lifts the placing plate 53. The lift mechanism 56 includes a lift motor 56*a* (see FIG. 3), a driving shaft 56*b*, and a push-up member 56*c*. The push-up member 56*c* is in the shape of a plate. The push-up member 56*c* is fitted to the driving shaft 56*b*. The driving shaft 56*b* rotates by being driven by the lift motor 56*a*. To make the push-up member 56*c* pivot, the controller 1 makes the lift motor 56*a* operate. As a result, the driving shaft 56*b* rotates. A tip end portion of the push-up member 56*c* ascends. When the push-up member 56*c* pivots, a downstream-side end part of the placing plate 53 ascends.

The sheet feeding rotary member 52 includes a sheet feeding roller 52*a* and a separating roller pair 52*b*. The sheet feeding roller 52*a* and the separating rollers make one unit. The sheet feeding roller 52*a* is provided over the downstream-side end part of the placing plate 53. The separating roller pair 52*b* is provided on the downstream side of the sheet feeding roller 52*a* in the conveying direction. The separating roller pair 52*b* prevents double feeding of sheets. The upper roller of the separating roller pair 52*b* rotates in such a direction as to send a sheet forward. The lower roller rotates in such a direction as to send a sheet backward (toward the cassette). The lower roller is configured not to rotate forward unless a predetermined force is applied to it. For example, a torque limiter is used. When double feeding of sheets is occurring, the lower roller sends the lower sheet backward. When double feeding of sheets is not occurring, the lower roller rotates forward.

As shown in FIG. 3, each sheet feeding unit 5 includes an upper limit sensor 5*a*, a set sensor 5*b*, a remaining quantity sensor 7, and a sheet feeding motor 57. The remaining quantity sensor 7 senses the remaining level of sheets that are set in the sheet feeding cassette 51 (on the placing plate 53). The remaining quantity sensor 7 includes a first sensor 71 and a second sensor 72 (see FIGS. 3 and 5). The rotary shaft of the sheet feeding roller 52*a* is supported on a supporting shaft member 58. The supporting shaft member 58 is laid on the rotary shaft of the separating roller pair 52*b*. With the supporting shaft member 58, the sheet feeding roller 52*a* can swing in the up-down direction. In accordance with the up-and-down movement of the sheet feeding roller 52*a*, the supporting shaft member 58 swings in the up-down direction. The upper limit sensor 5*a* is provided in the sheet feeding unit 5. The upper limit sensor 5*a* senses that the sheet feeding roller 52*a* lifted up by the placing plate 53 has reached a prescribed upper limit position.

When the downstream-side end part of the placing plate 53 is raised, the sheet feeding roller 52*a* and a top-most sheet make contact with each other. When the placing plate 53 is raised further, the sheet feeding roller 52*a* is lifted up together. That is, the placing plate 53 lifts up the sheet feeding roller 52*a*. When the upper limit sensor 5*a* senses that the sheet feeding roller 52*a* has reached its upper limit, also the placing plate 53 is at an upper limit position. The position of the placing plate 53 at the upper limit varies depending on the thickness of the set bundle of sheets. The controller 1 raises the placing plate 53 according to the remaining quantity of sheets such that the sheet feeding roller 52*a* and the sheets make contact with each other.

The upper limit sensor 5*a* is, for example, an optical sensor of a transmissive type. The upper limit sensor 5*a* outputs a signal of which the level changes (between High and Low levels) depending on whether the sheet feeding roller 52*a* is at its upper limit position or not. A projection 59 is provided on the sheet feeding roller 52*a* or on the supporting shaft member 58. When the sheet feeding roller 52*a* reaches its upper limit position, the projection 59 obstructs the optical path from the light emitting portion to the light receiving portion of the upper limit sensor 5*a* (optical sensor). The controller 1 recognizes that the sheet feeding roller 52*a* has reached its upper limit based on the output from the upper limit sensor 5*a*. Upon recognizing that the sheet feeding roller 52*a* has reached its upper limit, the controller 1 stops the lift motor 56*a*.

With reference to FIG. 4, the lift mechanism 56 will now be described. The lift motor 56*a* is provided outside the sheet feeding cassette 51 (on the main body side). The longitudinal direction of the driving shaft 56*b* is a direction perpendicular to the sheet conveying direction. The driving shaft 56*b* is coupled to the lift motor 56*a* via a joint member 56*d*. The controller 1 drives the lift motor 56*a*. As the lift motor 56*a* rotates, the joint member 56*d* rotates together. As the joint member 56*d* rotates, the driving shaft 56*b* and the push-up member 56*c* rotate. When sheet feeding is performed, the controller 1 rotates the lift motor 56*a* (the driving shaft 56*b*, the push-up member 56*c*) in such a direction as to raise the placing plate 53.

When the sheet feeding cassette 51 is pulled out forward, the joint member 56*d* and the driving shaft 56*b* decouple. As a result, the driving transmission path is cut off. When the sheet feeding cassette 51 is removed (decoupled), the placing plate 53 descends automatically by the action of gravity. The lift mechanism 56 makes the placing plate 53 descend under gravity. Eventually, the placing plate 53 and the push-up member 56*c* descend down to their lower limit positions. The placing plate 53 and the push-up member 56*c* lie flat.

When the sheet feeding cassette 51 is attached, the driving shaft 56*b* is inserted in the joint member 56*d*. Via the joint member 56*d*, the lift motor 56*a* and the driving shaft 56*b* are coupled to each other. Based on the output of an open/close sensor (unillustrated), the controller 1 recognizes that the sheet feeding cassette 51 has been attached. By the time sheet feeding is started, the controller 1 drives the lift motor 56*a*. The controller 1 raises the sheet feeding roller 52*a* (placing plate 53) up to its upper limit position. In addition, the controller 1 momentarily rotates the lift motor 56*a* every time one sheet is or a plurality of sheets are fed. The sheet feeding roller 52*a* that has descended a little due to sheet consumption is lifted up to the upper limit position again.

During sheet feeding, the controller 1 rotates the sheet feeding motor 57. With this, the sheet feeding roller 52*a* and the separating roller pair 52*b* rotate. By the sheet feeding roller 52*a* and the separating roller pair 52*b*, sheets are conveyed downstream. In the conveying unit 4*a*, a plurality of conveying roller pairs 41 are provided. Sheets are conveyed by these conveying roller pairs 41 (see FIG. 2). For convenience, only one conveying roller pair 41 is shown in FIG. 2. When consecutive printing is performed on a plurality of sheets, the controller 1 repeats starting and stopping the rotation of the sheet feeding roller 52*a* such that the interval between each sheet is constant.

The sheet feeding unit 5 is provided with a set sensor 5*b*. The set sensor 5*b* is a sensor for sensing whether sheets are set or not (for example, an optical sensor). The output level of the set sensor 5*b* when sheets are set is different from that when sheets are not set (between High level or Low level). Based on the output of the set sensor 5*b*, the controller 1 can sense whether sheets are set in the sheet feeding cassette 51. Upon sensing the absence of sheets, the controller 1 makes the display panel 31 display that the sheets have run out.

A sheet feeding sensor 8 is provided on the downstream side of the separating rollers in the sheet conveying direction. The output level of the sheet feeding sensor 8 changes (between High and Low levels) depending on whether the presence of a sheet is being sensed or not. That is, the sheet feeding sensor 8 senses that the sheet fed from the sheet feeding unit 5 has reached and passed the sheet feeding sensor 8. The output of the sheet feeding sensor 8 is input to the controller 1. Based on the output of the sheet feeding sensor 8, the controller 1 recognizes that a sheet has reached and passed a position where the sheet feeding sensor 8 is provided. For example, the sheet feeding sensor 8 is an optical sensor of a transmissive type. The sheet feeding sensor 8 may be a sensor of any other type.

Sensing Remaining Quantity of Sheets

Next, with reference to FIGS. 3 and 5, one example of sensing the remaining level of sheets in the image forming apparatus 100 according to the embodiment will be described.

Figure 5:
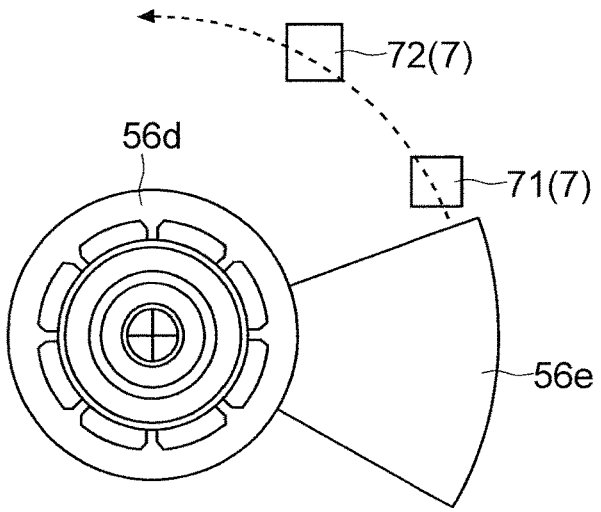
FIG. 5 is a diagram showing one example of remaining quantity sensing according to the embodiment.

As shown in FIG. 5, a fan-shaped rotary plate 56*e* is fitted to the joint member 56*d*. The rotation angle of the rotary plate 56*e* changes according to the rotation angle of the joint member 56*d* (driving shaft 56*b*). On a path along which an arc part of the rotary plate 56*e* moves, there are provided a first sensor 71 and a second sensor 72. The first sensor 71 and the second sensor 72 are optical sensors of a transmissive type. The rotary plate 56*e* (the arc part, an end part) passes between the light emitting portion and the light receiving portion of the first sensor 71 and the second sensor 72. The first sensor 71 and the second sensor 72 output different levels depending on whether they are in a light-transmitted state or in a light-shielded state. The outputs of the first sensor 71 and the second sensor 72 are input to the controller 1. Based on the combination of the output values input to it, the controller 1 recognizes the remaining level of sheets.

Figure 7:
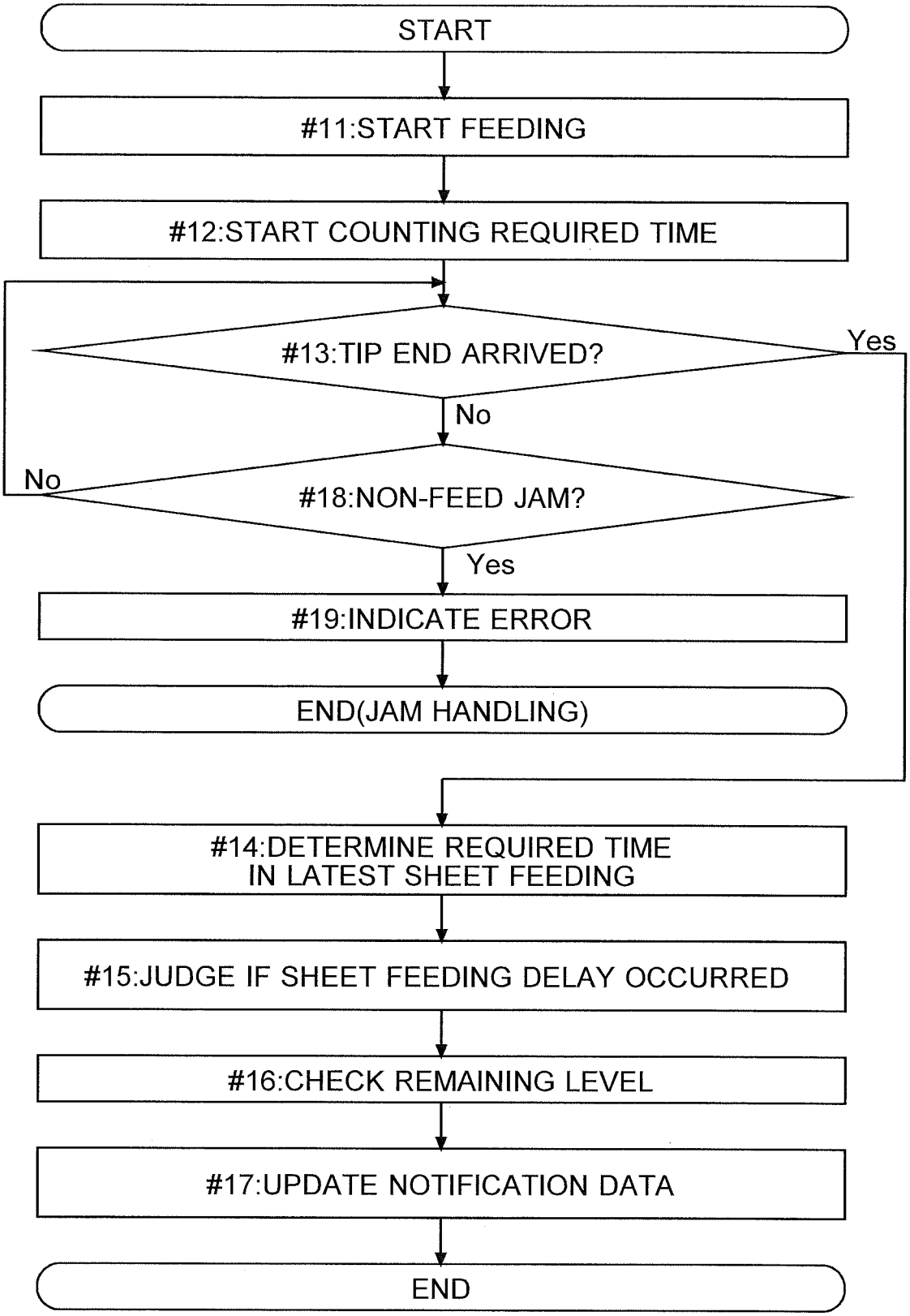
FIG. 7 is a diagram showing one example of processing during sheet feeding in the image forming apparatus of the embodiment.

Depending on the rotation amount of the driving shaft 56*b*, the number of sensors that the rotary plate 56*e* shields from light changes. FIG. 7 shows one example of a procedure when the remaining amount is, for example, 100%. To bring the sheet feeding roller 52*a* and sheets into contact with each other, the controller 1 rotates the driving shaft 56*b* in the counter-clockwise direction. In the example in FIG. 7, the thinner the bundle of sheets set on the placing plate 53 is, the larger the rotation amount of the rotary plate 56*e* (driving shaft 56*b*) is up to the upper limit of the sheet feeding roller 52*a*.

When the rate X of the thickness of the bundle of sheets that is set relative to the thickness of the bundle of sheets at full load is 75% <X≤100%, the first sensor 71 and the second sensor 72 are provided at positions at which they are not shielded from light by the rotary plate 56*e*. When the rate X of the thickness of the bundle of sheets that is set relative to the thickness of the bundle of sheets at full load is 50% <X≤75%, the first sensor 71 is provided at a position at which it is shielded from light by the rotary plate 56*e*, and the second sensor 72 is provided at a position at which it is not shielded from light by the rotary plate 56*e*. When the rate X of the thickness of the bundle of sheets that is set relative to the thickness of the bundle of sheets at full load is 25%<X≤50%, the first sensor 71 and the second sensor 72 are provided at positions at which they are shielded from light by the rotary plate 56*e*. When the rate X of the thickness of the bundle of sheets that is set relative to the thickness of the bundle of sheets at full load is 0%≤X≤25%, the first sensor 71 is provided at a position at which it is not shielded from light by the rotary plate 56*e*, and the second sensor 72 is provided at a position at which it is shielded from light by the rotary plate 56*e* (see FIG. 5).

Based on the output levels of the first sensor 71 and the second sensor 72, the controller 1 recognizes the remaining level (range of the remaining quantity) of sheets. When the output levels of the first sensor 71 and the second sensor 72 are those in the light-transmitted state, the controller 1 recognizes that the remaining level is 4 (the remaining quantity 75%<X≤100%). When the output level of the first sensor 71 is that in the light-shielded state and the output level of the second sensor 72 is that in the light-transmitted state, the controller 1 recognizes that the remaining level is 3 (the remaining quantity 50%<X≤75%). When the output levels of the first sensor 71 and the second sensor 72 are those in the light-shielded state, the controller 1 recognizes that the remaining level is 2 (the remaining quantity 25%<X≤50%). When the output level of the first sensor 71 is that in the light-transmitted state and the output level of the second sensor 72 is that in the light-shielded state, the controller 1 recognizes that the remaining level is 1 (the remaining quantity 0%≤X≤25%). In this way, the controller 1 recognizes the remaining level of sheets in the sheet feeding cassette 51 based on the output of the remaining quantity sensor 7.

Relationship between the Remaining Quantity of Sheets and Sheet Feeding

Figure 6:
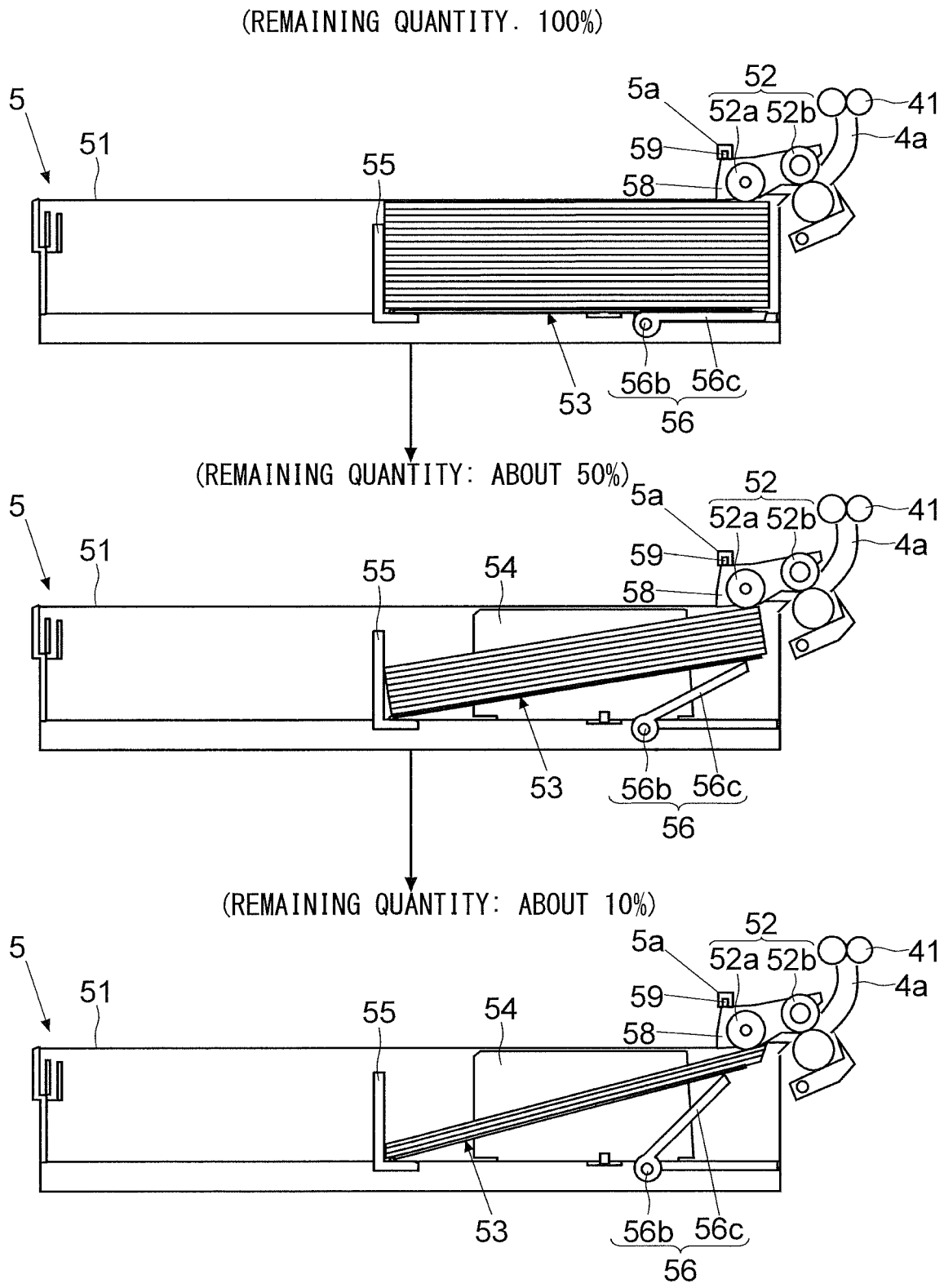
FIG. 6 is a diagram showing one example of sheet feeding states for each remaining level of sheets in the image forming apparatus of the embodiment.

Next, with reference to FIG. 6, one example of the relationship between the remaining quantity of sheets and sheet feeding in the image forming apparatus 100 according to the embodiment will be described. The top part of FIG. 6 shows one example of the sheet feeding unit 5 when the remaining quantity of sheets is 100%. The top part of FIG. 6 shows a state where the thickness of the set bundle of sheets is the largest thickness allowed in the specifications. For example, when 500 sheets of plain paper are set, the remaining quantity of sheets is 100%. When the sheet feeding unit 5 is in the state shown in the top part of FIG. 6, the controller 1 judges that the remaining level is 4.

The middle part of FIG. 6 shows one example of the sheet feeding unit 5 when the remaining quantity of sheets is about 50%. The middle part of FIG. 6 shows a state where the thickness of the set bundle of sheets is about half of the largest thickness allowed in the specifications. When the sheet feeding unit 5 is in the state of the middle part of FIG. 6, the controller 1 judges that the remaining level is 2 or 3.

The bottom part of FIG. 6 shows one example of the sheet feeding unit 5 when the remaining quantity of sheets is about 10%. The bottom part of FIG. 6 shows a state where the thickness of the set bundle of sheets is about 10% of the largest allowed thickness according to the specifications. When the sheet feeding unit 5 is in the state of the bottom part of in FIG. 6, the controller 1 judges that the remaining level is 1.

As shown in different parts of FIG. 6, how the sheets make contact with the sheet feeding roller 52*a* (the state of contact) changes depending on the remaining quantity of sheets. When the remaining quantity is 100%, sheets are almost flat. On the other hand, the smaller the remaining quantity is, the more the sheets making contact with the sheet feeding roller 52*a* are inclined relative to the horizontal plane. The more the placing plate 53 is inclined, the further up the sheets need to be pulled to be sent out. Depending on the remaining quantity of sheets, the approach angle of sheets to a conveying member (separating roller pair 52*b*) that follows the sheet feeding rotary member 52 (sheet feeding roller 52*a*) changes. In this way, the behavior of sheets during sheet feeding changes depending on the remaining quantity of sheets. As a result, how likely sheet feeding delays are (incidence) may be different depending on the remaining quantity of sheets. Thus, the image forming apparatus 100 of the embodiment calculates incidences at different remaining levels of sheets.

Processing of Image Forming Apparatus 100 during Sheet Feeding

Figures 8, 9:
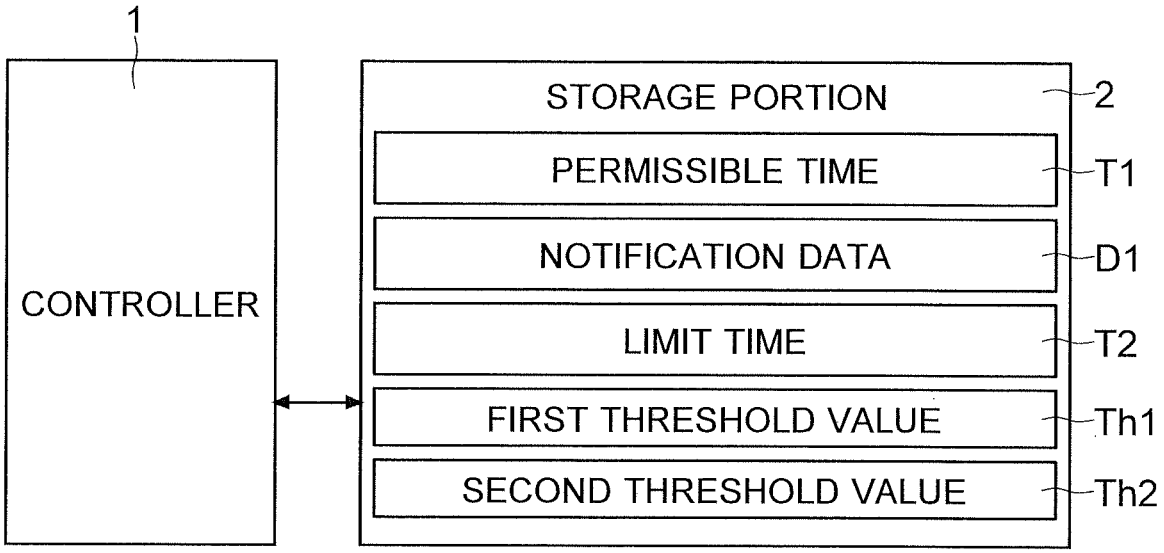
FIG. 8 is a diagram showing one example of contents stored in a storage portion according to the embodiment.
FIG. 9 is a diagram showing one example of notification data according to the embodiment.

Next, with reference to FIGS. 7 to 9, one example of processing during sheet feeding in the image forming apparatus 100 according to the embodiment will be described. The controller 1 controls sheet feeding. Based on programs and data stored in the storage portion 2, the controller 1 controls the operation of the sheet feeding rotary member 52. In addition, the controller 1 includes the time counter 1*b*. Based on the output of the sheet feeding sensor 8, the time counter 1*b* counts the time required after the sheet feeding rotary member 52 (sheet feeding motor 57) starts to rotate until the sheet feeding sensor 8 senses the tip end of a sheet. The required time may be counted by the CPU 1*a*.

Next, with reference to FIG. 7, one example of a procedure during sheet feeding processing in the image forming apparatus 100 according to the embodiment will be described. START in FIG. 7 is a time point when the controller 1 makes the sheet feeding unit 5 start sheet feeding. For example, when the communication portion 6 receives print job data, the controller 1 starts sheet feeding. The controller 1 performs the procedure in the flow chart in FIG. 7 for each sheet.

The controller 1 rotates the sheet feeding rotary member 52 (sheet feeding motor 57) and starts sheet feeding (step #11). The controller 1 starts sheet feeding after raising the placing plate 53 according to the remaining quantity of sheets such that the sheet feeding roller 52*a* makes contact with the sheets. In other words, before sheet feeding, the controller 1 operates the lift motor 56*a* until the upper limit sensor 5*a* senses that the sheet feeding roller 52*a* has reached its upper limit.

Simultaneously with the start of sheet feeding, the controller 1 (time counter 1*b*) starts counting the required time (step #12). The required time is the time after the sheet feeding rotary member 52 (sheet feeding motor 57) starts to rotate until the sheet feeding sensor 8 senses the tip end of a sheet. The controller 1 checks whether the sheet feeding sensor 8 has sensed the arrival of the tip end of a sheet (step #13). When the sheet feeding sensor 8 senses the arrival of the tip end (Yes in step #13), the controller 1 (time counter 1*b*) determines the time required for this sheet feeding (step #14).

When the required time is determined (after step #14), the controller 1 judges whether a sheet feeding delay has occurred in this session of sheet feeding (step #15). Specifically, the controller 1 judges that a sheet feeding delay has occurred when the required time exceeds a prescribed permissible time T1. On the other hand, when the required time is shorter than the permissible time T1, the controller 1 judges that there has been no sheet feeding delay.

The permissible time T1 is the sum of an ideal required time and a prescribed margin. For example, the ideal required time is the time obtained by dividing the distance from the tip end position of an ideally set sheet to the sheet feeding sensor 8 by an ideal sheet conveying speed (according to the specifications). The storage portion 2 stores the permissible time T1 in a non-volatile manner (see FIG. 8). The controller 1 makes the judgement by reading the permissible time T1 stored in the storage portion 2.

The controller 1 checks the current remaining level (step #16). Then, the controller 1 makes the storage portion 2 update notification data D1 (step #17). As shown in FIG. 9, the controller 1 makes the storage portion 2 store the cumulative number of fed sheets for each remaining level and the number of sheets whose sheet feeding has delayed for each remaining level as notification data D1 in a non-volatile manner. The controller 1 makes the storage portion 2 store the incidence of sheet feeding delays for each remaining level as notification data D1. Then, the procedure ends (END).

When updating notification data D1, the controller 1 increments by 1 the cumulative number of fed sheets corresponding to the remaining level at the time of the sheet feeding. When it is judged that a sheet feeding delay has occurred, the controller 1 increments by 1 the number of sheets whose feeding has delayed corresponding to the remaining level at the point of sheet feeding. When it is judged that no sheet feeding delay has occurred, the controller 1 does not increment the number of sheets whose feeding has delayed for any of the remaining levels. In other words, when it is judged that no sheet feeding delay has occurred, the controller 1 does not change the value of the number of sheets whose feeding has delayed. Further, when a sheet feeding delay has occurred, the controller 1 updates the incidence of sheet feeding delays for the remaining level at the time of the sheet feeding. Specifically, the controller 1 calculates the incidence at the remaining level at the time of the sheet feeding by dividing the updated number of sheets whose feeding has delayed by the updated cumulative number of fed sheets.

On the other hand, when the sheet feeding sensor 8 does not sense the arrival of the tip end (No in step #13), the controller 1 judges whether a non-feed jam has occurred (step #18). The controller 1 judges that a non-feed jam has occurred when the required time exceeds a prescribed limit time T2. The limit time T2 is stored in the storage portion 2 in a non-volatile manner (see FIG. 8). The controller 1 can communicate with the storage portion 2.

The controller 1 can perform a retry once or a plurality of times. A retry involves temporarily stopping and then restarting the rotation of the sheet feeding rotary member 52 (sheet feeding roller 52*a*). Every time the sheet feeding rotary member 52 restarts to rotate for a retry, the controller 1 starts counting the required time. When the required time exceeds the limit time T2 for a plurality of times consecutively, the controller 1 recognizes that a non -feed jam has occurred.

When it is judged that no non-feed jam has occurred (No in step #18), the procedure returns to step #13. On the other hand, when it is judged that a non-feed jam has occurred (Yes in step #18), the controller 1 makes the display panel 31 display a non-feed jam error (step #19). The controller 1 may make the communication portion 6 transmit a non -feed jam occurrence notification toward the computer 200 from which the print job data has been transmitted. The controller 1 stops operation of the printing unit 4 including the sheet feeding motor 57. Then, the procedure ends (END). When a non-feed jam has occurred, a user performs jam handling.

Notification based on Incidence

Next, with reference to FIGS. 10 and 11, one example of notification based on incidence in the image forming apparatus 100 according to the embodiment will be described. The controller 1 calculates the incidence of sheet feeding delays for each remaining level of sheets in the sheet feeding cassette 51. When there are a plurality of sheet feeding portions 5, the controller 1 performs the procedure in the flow chart in FIG. 7 for each sheet feeding unit 5. The controller 1 performs notification based on the calculated incidence. With respect to notification, a first threshold value Th1 and a second threshold value Th2 are determined in advance. The storage portion 2 stores the first threshold value Th1 and the second threshold value Th2 in a non-volatile manner (see FIG. 8). The first threshold value Th1 is smaller than the second threshold value Th2.

Figure 10:
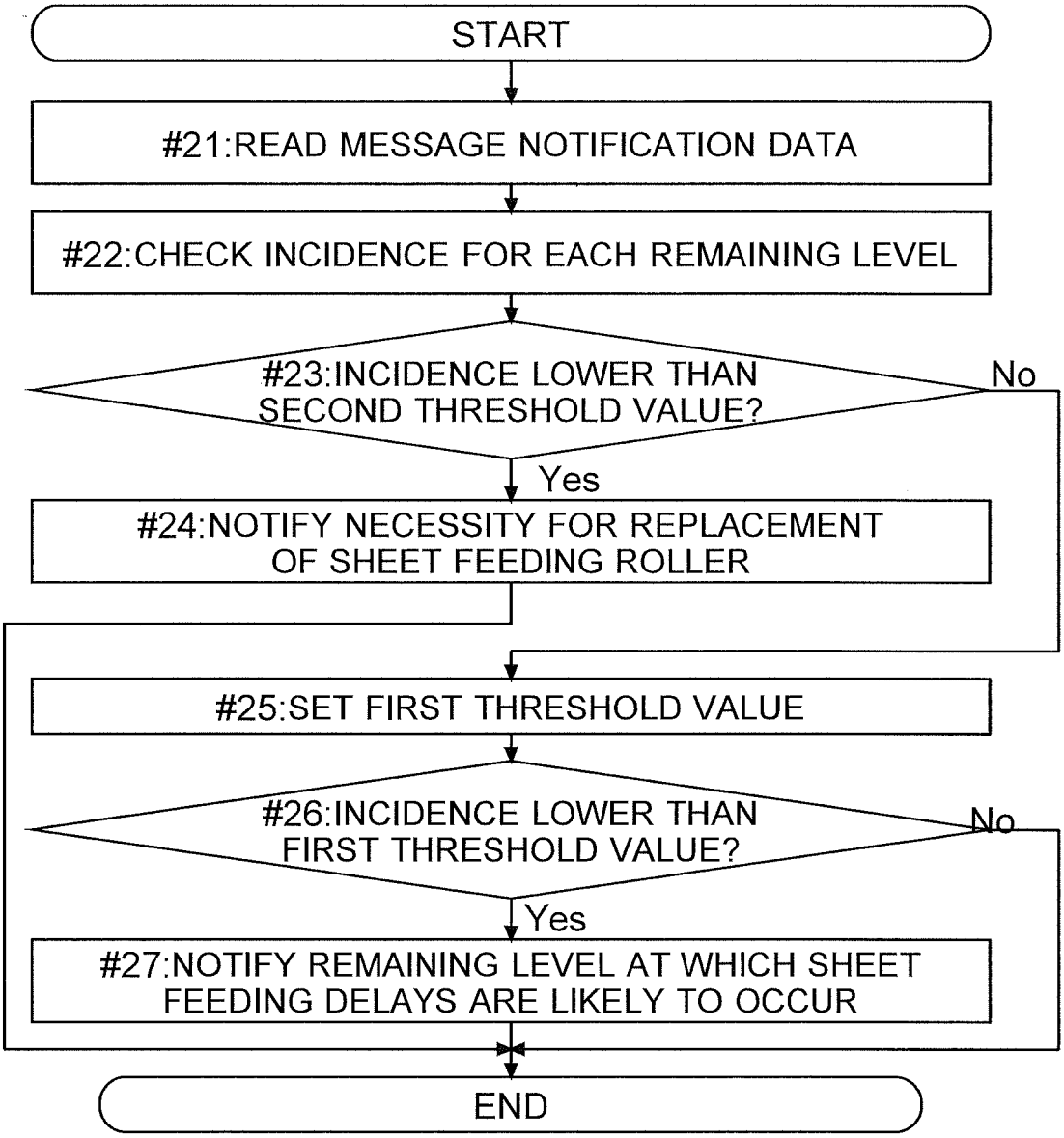
FIG. 10 is a diagram showing one example of notification based on an incidence according to the embodiment.

START in FIG. 10 is, for example, the time when a job is finished. It may be when one sheet is fed (when the required time is counted). Or, it may be at a time point when, as a result of the main power being turned on, the image forming apparatus 100 completes starting up. Or, it may be a time point when, having recovered from a power saving mode, the image forming apparatus 100 enters an active mode (normal mode).

First, the controller 1 reads notification data D1 from the storage portion 2 (step #21). Based on the read notification data D1, the controller 1 checks the incidence at each remaining level (step #22). Then, the controller 1 checks whether the incidences at all the remaining levels are equal to or lower than a prescribed second threshold value Th2 (step #23). The second threshold value Th2 is appropriately determined. The second threshold value Th2 may be, for example, a value of about 30%. The controller 1 may calculate a value by dividing the sum of the number of sheets whose feeding has delayed for each remaining level by the sum of the cumulative number of fed sheets for each remaining level. The controller 1 may check whether the calculated value is equal to or lower than the second threshold value Th2. When any of the calculated incidences at each remaining level exceeds the second threshold value Th2 (Yes in step #23), the controller 1 makes the notification portion notify necessity for replacement of the sheet feeding rotary member 52 (step #24). That is, the controller 1 recommends replacing the sheet feeding rotary member 52 (sheet feeding roller 52*a*). Then, the procedure ends (END).

The notification portion is, for example, a display panel 31. In that case, the controller 1 includes, in the notification, information indicating the sheet feeding unit 5 in which the incidence has exceeded the second threshold value Th2, a character string notifying that wear has advanced, and a character string notifying that the sheet feeding roller 52*a* should be replaced. The controller 1 may include contact information of a company that maintains the image forming apparatus 100 in the notification.

The main controller may be the communication portion 6. In that case, the controller 1 makes the communication portion 6 transmit data including information, character strings, and contact information as mentioned above. For example, the controller 1 transmits data toward the computer 200 of an administrator of the image forming apparatus 100. With this, a notification based on the data is displayed on the display of the computer 200 of the administrator of the image forming apparatus 100. The administrator can recognize the need to request replacement of the sheet feeding roller 52*a*. Further, the controller 1 may make the communication portion 6 transmit a notification toward the computer 200 of the company that maintains the image forming apparatus 100. In that case, the controller 1 makes the communication portion 6 transmit data including the installation location of the image forming apparatus 100, contact information of the administrator of the image forming apparatus 100, and information indicating the sheet feeding unit 5 that requires replacement.

When there is no incidence that exceeds the second threshold value Th2 (No in step #23), the controller 1 determines the first threshold value Th1 (step #25). The controller 1 may use a prescribed fixed first threshold value Th1 stored in the storage portion 2. The controller 1 may determine the first threshold value Th1 for each remaining level. In that case, the remaining levels used in the image forming apparatus 100 are in four steps, the controller 1 calculates 4 first threshold values Th1 (see FIG. 8). The controller 1 decreases the first threshold value Th1 as the incidence increases. The controller 1 increases the first threshold value Th1 as the incidence decreases. With this, the incidence of a remaining level with a higher incidence is more likely to exceed the first threshold value Th1.

The controller 1 recognizes whether the calculated incidences at all the remaining levels are equal to or lower than a first threshold value Th1 (step #26). In other words, the controller 1 recognizes any remaining level at which the incidence exceeds the first threshold value Th1. When there is no incidence that exceeds the first threshold value Th1 (No in step #26), no notification is necessary. It can be considered that wear of the sheet feeding roller 52*a* has not advanced. It can be judged that sheets are conveyed with no abnormalities. Then, the procedure ends (END).

When the incidence at any remaining level exceeds the first threshold value Th1 (Yes in step #26), the controller 1 makes the notification portion notify the remaining level at which the incidence exceeds the first threshold value Th1 (step #27). In other words, the controller 1 makes the notification portion notify the remaining level at which sheet feeding delays are likely to occur. Then, the procedure ends (END).

Figure 11:
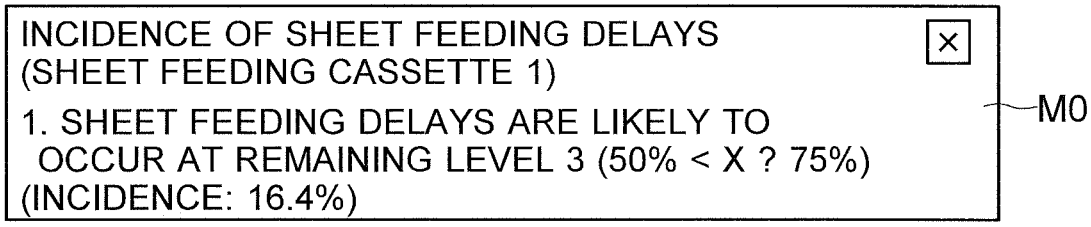
FIG. 11 is a diagram showing one example of a current state notification according to the embodiment.

FIG. 11 shows one example of a current state notification M0 displayed in step #27. The current state notification M0 is a notification that notifies the remaining level at which currently sheet feeding delays are likely to occur. The controller 1 makes the display panel 31 display the current state notification M0. The controller 1 can make the communication portion 6 notify (transmit) data for displaying the current state notification M0 toward the computer 200 of an administrator. In that case, the current state notification M0 is displayed on the display of the computer 200.

FIG. 11 shows one example of a notification that notifies that the incidence at the remaining level 3 exceeds the first threshold value Th1. When wear of the sheet feeding roller 52*a* advances, the incidences at a plurality of remaining levels are likely to exceed the first threshold value Th1. Thus, the controller 1 may display a current state notification M0 that notifies that the incidences at a plurality of remaining levels are exceeding the first threshold value Th1. Operating the cross-marked button can close the current state notification M0.

Notification of Remaining Quantity Adjustment

Figure 12:
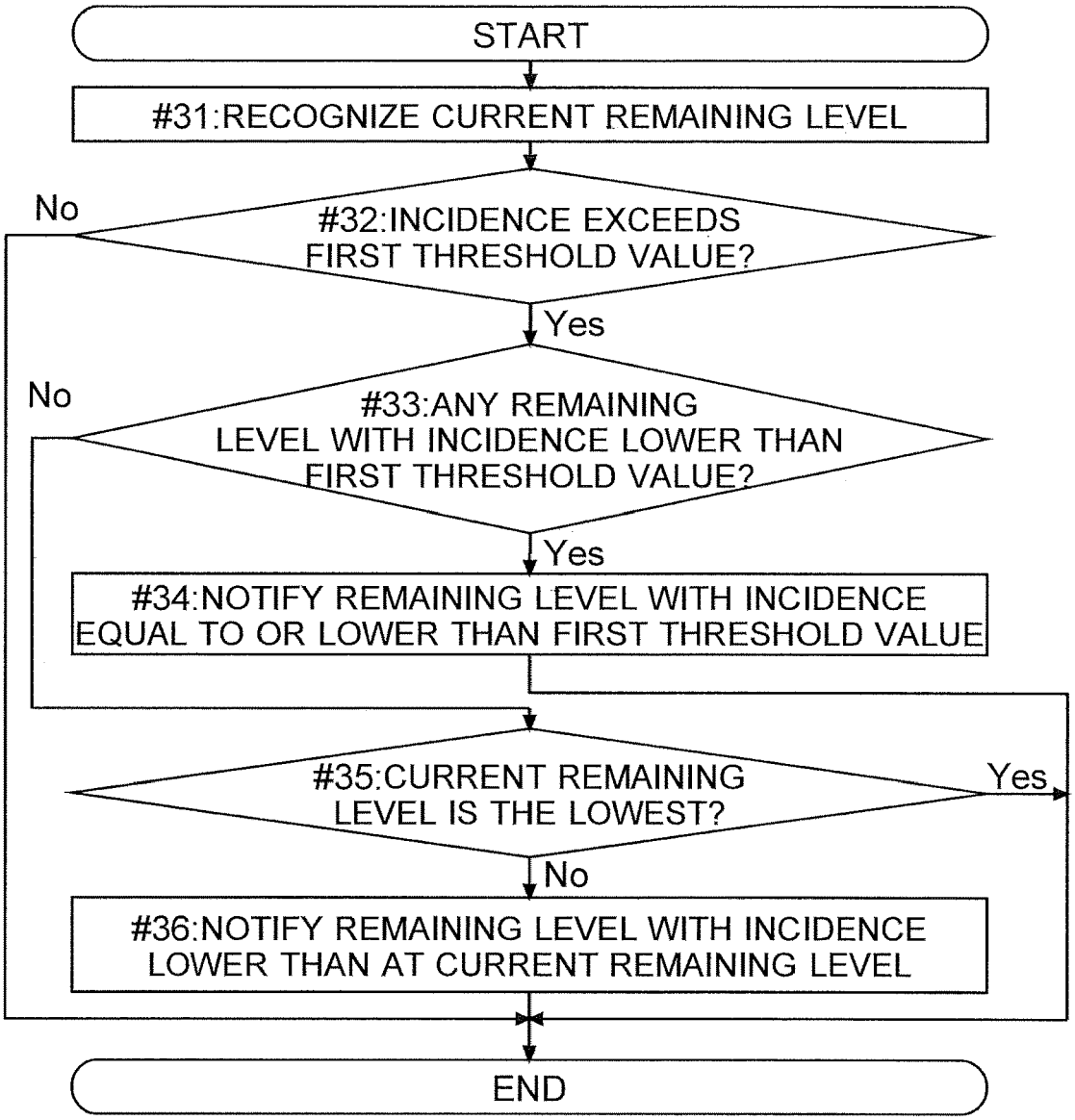
FIG. 12 is a diagram showing one example of remaining sheet quantity adjustment notification in the image forming apparatus according to the embodiment.

Next, with reference to FIGS. 12 to 14, one example of remaining sheet quantity adjustment notification in the image forming apparatus 100 according to the embodiment will be described. START in FIG. 12 is the time point when prescribed remaining quantity notification is performed. The time point when remaining quantity notification is performed can be appropriately determined. The time point when remaining quantity adjustment notification is performed can be the time point when job setting is about to be started. Before starting a printing job, the image forming apparatus 100 can prompt adjustment of the remaining quantity of sheets. For example, the time point when remaining quantity adjustment notification is performed may be the time point when the controller 1 recognizes operation on the operation panel 3.

The time point when remaining quantity adjustment notification is performed may be the time point when the current state notification M0 is displayed. In other words, the time point when remaining quantity adjustment notification is performed may be the time point when the controller 1 recognizes that the incidence at any remaining level is exceeding the first threshold value Th1. Or, the time point when remaining quantity adjustment notification is performed may be the time point when, as a result of the main power being turned on, the image forming apparatus 100 completes starting up. Or, it may be the time point when, having recovered from a power saving mode, the image forming apparatus 100 enters an active mode (normal mode). The image forming apparatus 100 includes a plurality of sheet feeding portions 5. The controller 1 performs the procedure in the flow chart in FIG. 12 for each sheet feeding unit 5.

The controller 1 recognizes the current remaining level (step #31). Then, the controller 1 checks whether the incidence at the current remaining level is exceeding the first threshold value Th1 (step #32). Here, the controller 1 may use the first threshold value Th1 (a prescribed fixed value) stored in the storage portion 2. Or, the controller 1 may determine the first threshold value Th1 for each remaining level (similar to step #24). In this case, the controller 1 decreases the first threshold value Th1 as the incidence increases. The controller 1 increases the first threshold value Th1 as the incidence decreases.

When the incidence at the current remaining level is equal to or lower than the first threshold value Th1 (No in step #32), it can be considered that sheet feeding delays and non-feed jams are unlikely to occur. Then, the controller 1 ends the procedure (END). On the other hand, when the incidence at the current remaining level exceeds the first threshold value Th1 (Yes in step #32), the controller 1 checks whether there is any remaining level at which the incidence is equal to or lower than the first threshold value Th1 (step #33). For example, when the current remaining level is 2 and the incidence at the remaining level 2 exceeds the first threshold value Th1, the controller 1 checks whether the incidences at the remaining levels 1, 3, and 4 are equal to or lower than the first threshold value Th1.

When there is a remaining level at which the incidence is equal to or lower than the first threshold value Th1 (Yes in step #33), the controller 1 makes the notification portion notify the remaining level at which the incidence is equal to or lower than the first threshold value Th1 (step #34). FIG. 13 is one example of a first remaining quantity adjustment notification M1 displayed in step #34. The first remaining quantity adjustment notification M1 is a notification for notifying the remaining level at which sheet feeding delays and non-feed jams are unlikely to occur. The controller 1 makes the display panel 31 display the first remaining quantity adjustment notification M1. The controller 1 may make the communication portion 6 notify (transmit) data for displaying the first remaining quantity adjustment notification M1 toward the computer 200 of an administrator. In that case, a first remaining quantity adjustment notification M1 is displayed on the display of the computer 200.

Figure 13:
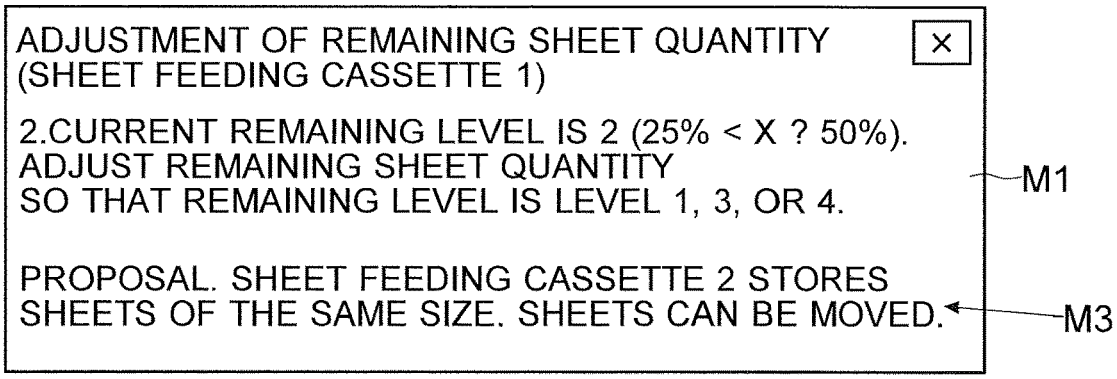
FIG. 13 is a diagram showing one example of a first remaining quantity adjustment notification according to the embodiment.

FIG. 13 shows an example of notifying with the first remaining quantity adjustment notification M1 that the current remaining level is level 2. FIG. 13 shows an example of notifying that the incidences at the remaining levels 1, 3, and 4 are lower than that at the current remaining level. Operating the cross-marked button can close the first remaining quantity adjustment notification M1. The first remaining quantity adjustment notification M1 may be displayed simultaneously with a notification of any other kind.

When there is no remaining levels at which the incidence is equal to or lower than the first threshold value Th1 (No in step #33), the controller 1 checks whether the incidence at the current remaining level is the lowest among the incidences at all the remaining levels (step #35). When it is the lowest (Yes in step #35), there is no other remaining level at which the incidence is lower than at the current one. Then, the controller 1 ends the procedure (END). When there is no remaining level at which the incidence is equal to or lower than the first threshold value Th1, and the incidence at the current remaining level is not the lowest (No in step #35), the controller 1 makes the notification portion notify the remaining level at which the incidence is lower than at the current remaining level (step #36). Then, the procedure ends.

Figure 14:
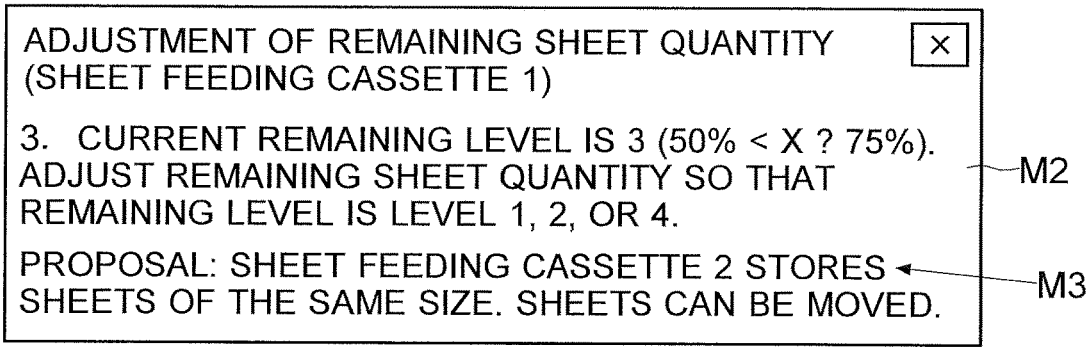
FIG. 14 is a diagram showing one example of a second remaining quantity adjustment notification according to the embodiment.

FIG. 14 shows one example of a second remaining quantity adjustment notification M2 displayed in step #36. The remaining quantity adjustment notification M2 is a notification for notifying the remaining level at which sheet feeding delays and non-feed jams are less likely to occur. The controller 1 makes the display panel 31 display the remaining quantity adjustment notification M2. The controller 1 may make the communication portion 6 notify (transmit) data for displaying the second remaining quantity adjustment notification M2 toward the computer 200 of an administrator. In that case, the second remaining quantity adjustment notification M2 is displayed on the display of the computer 200.

FIG. 14 shows one example of notifying that the current remaining level is 3. FIG. 14 also shows an example of notifying that the incidences at the remaining levels 1, 2, and 4 are lower than that at the current remaining level. When there is no remaining level at which the incidence is equal to or lower than the first threshold value Th1, the controller 1 may make the notification portion notify only the remaining level with the lowest incidence. Operating the cross-marked button can close the second remaining quantity adjustment notification M2. The second remaining quantity adjustment notification M2 may be displayed simultaneously with a notification of any other kind.

The image forming apparatus 100 includes a plurality of sheet feeding portions 5 (the sheet feeding cassettes 51). The sheet feeding roller 52*a* and the remaining quantity sensor 7 are provided for each sheet feeding cassette 51. The controller 1 recognizes the remaining level for each sheet feeding cassette 51. The controller 1 makes the storage portion 2 store notification data D1 for each sheet feeding cassette 51 in a non-volatile manner. In the case a plurality of sheet feeding cassettes 51 store sheets of the same size, when the incidence at the current remaining level in one of the cassettes having sheets of the same size or in all the cassettes having sheets of the same size exceeds the first threshold value Th1, the controller 1 may make the notification portion notify a proposal notification M3 that proposes moving the sheets between the cassettes having sheets in the same size.

FIGS. 13 and 14 show one example of a proposal notification M3. The proposal notification M3 is a notification for notifying a sheet feeding cassette 51 that stores sheets of the same size. The controller 1 makes the display panel 31 display the proposal notification M3 as well as the first remaining quantity adjustment notification M1 and the second remaining quantity adjustment notification M2. The controller 1 can make the communication portion 6 notify (transmit) data for displaying the proposal notification M3 toward the computer 200 of an administrator. In that case, the proposal notification M3 is displayed on the display of the computer 200.

The controller 1 recognizes the size of the sheets stored in each sheet feeding cassettes 51. For example, the operation panel 3 accepts setting of the size of the sheets stored in the sheet feeding cassette 51. The controller 1 recognizes that sheets of the set size are stored in the sheet feeding cassettes 51. A size sensor (unillustrated) for sensing the size of the stored sheets may be provided in the sheet feeding cassette 51. In this case, the controller 1 recognizes the size of the stored sheets based on the output from the size sensor. The controller 1 can recognize the sheet feeding cassettes 51 storing the sheets of the same size.

Recommendation Notification M4

Figure 15:
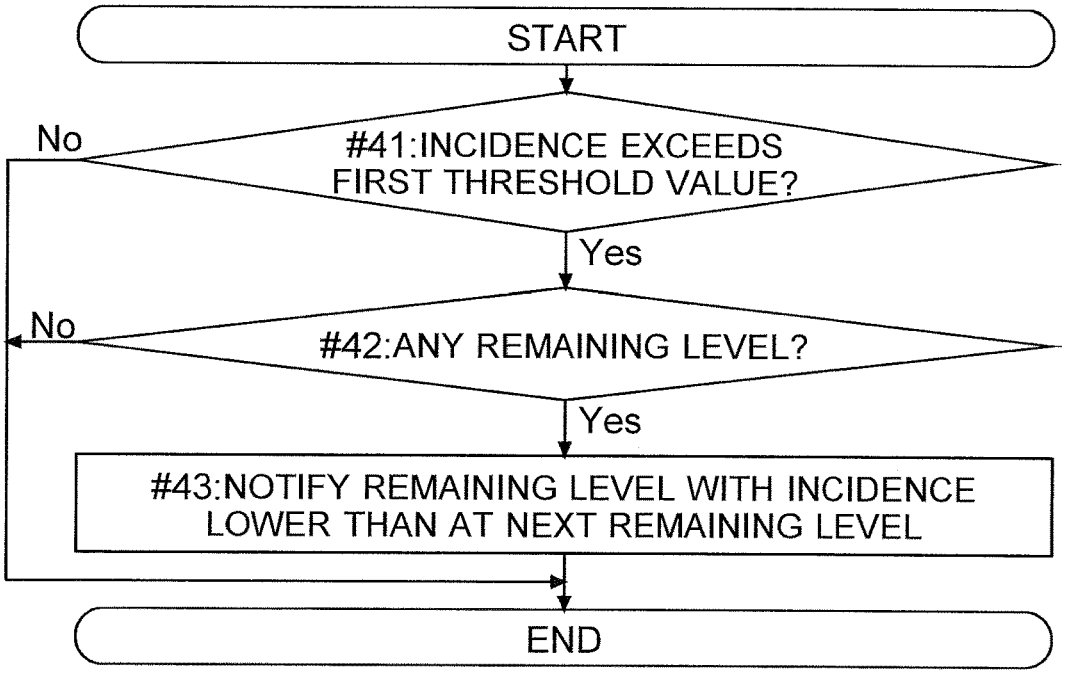
FIG. 15 is a diagram showing one example of recommendation notification according to the embodiment.

Next, with reference to FIGS. 15 and 16, one example of recommendation notification M4 for the next remaining level in the image forming apparatus 100 according to the embodiment will be described. START in FIG. 15 is a time point when prescribed recommendation notification M4 is performed. The time point when the recommendation notification M4 is performed can be appropriately determined. The time point when the recommendation notification M4 is performed may be the time point when the controller 1 recognizes operation on the operation panel 3. The time point when the recommendation notification M4 is performed may be the time point when the current state notification M0 is displayed. In other words, it may be the time point when the controller 1 recognizes that the incidence at any remaining level is exceeding the first threshold value Th1. Or, the time point when the recommendation notification M4 is performed may be the time point when, as a result of the main power being turned on, the image forming apparatus 100 completes starting up. Or, it may be the time point when, having recovered from a power saving mode, the image forming apparatus 100 enters an active mode (normal mode). The image forming apparatus 100 includes a plurality of sheet feeding portions 5. The controller 1 performs the procedure in the flow chart in FIG. 15 for each sheet feeding unit 5.

First, the controller 1 checks whether the incidence at the next remaining level is exceeding the first threshold value Th1 (step #41). The next remaining level is a remaining level that is one level lower than the current level. Here, the controller 1 may use the first threshold value Th1 (a prescribed fixed value) stored in the storage portion 2. Or, the controller 1 may determine the first threshold value Th1 for each remaining level (similar to step #24). In this case, the controller 1 decreases the first threshold value Th1 as the incidence increases. The controller 1 increases the first threshold value Th1 as the incidence decreases.

Next, the controller 1 checks whether there is any remaining level at which the incidence is lower than at the next remaining level (step #42). When there is no remaining levels at which the incidence is lower than at the next remaining level (No in step #42), the controller 1 ends the procedure (END). When there is a remaining level at which the incidence is lower than at the next level (Yes in step #42), the controller 1 makes the notification portion notify the remaining level at which the incidence is lower than at the next remaining level (step #43). Then, the procedure ends (END).

Figure 16:
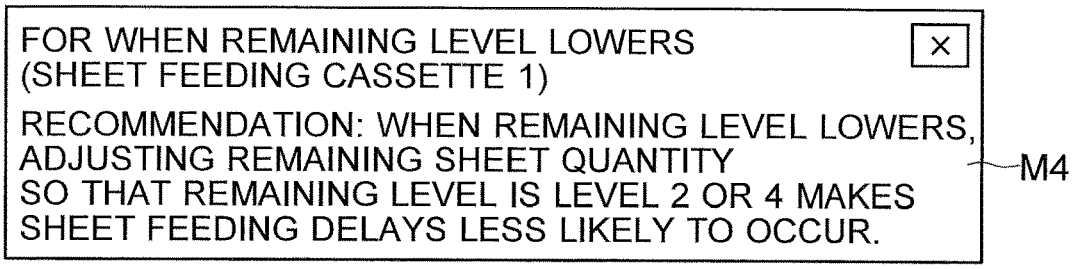
FIG. 16 is a diagram showing one example of a recommendation notification according to the embodiment.

FIG. 16 shows one example of a recommendation notification M4 displayed in step #43. The recommendation notification M4 is a notification for notifying, in advance, in preparation for when the remaining level lowers by one level due to sheet consumption, the remaining level at which sheet feeding delays and non-feed jams are less likely to occur. The controller 1 makes the display panel 31 display the recommendation notification M4. The controller 1 can make the communication portion 6 notify (transmit) data for displaying the recommendation notification M4 toward the computer 200 of an administrator. In that case, the recommendation notification M4 is displayed on the display of the computer 200.

With the recommendation notification M4, the controller 1 notifies the remaining level at which the incidence is lower than that at the next remaining level. FIG. 16 shows an example of notifying that, when the remaining level lowers, choosing the remaining level 2 or 4 lowers the incidence of sheet feeding delays. When there is no remaining level at which the incidence is equal to or lower than at the first threshold value Th1, the controller 1 may make the notification portion notify only the remaining level at which the incidence is the lowest. Operating the cross-marked button can close the recommendation notification M4. The recommendation notification M4 may be displayed simultaneously with a notification of any other kind.

Adequate Choice Notification M5

Next, with reference to FIGS. 17 and 18, one example of adequate choice notification M5 during sheet replenishment in the image forming apparatus 100 according to the embodiment will be described. The adequate choice notification M5 is notification which, when sheets have run out, notifies an adequate choice (adequate level) of the remaining level after sheet replenishment. Thus, it is preferable to perform the adequate choice notification M5 while the remaining level is the lowest level. Thus, the controller 1 starts the procedure in FIG. 17 only during a period in which the remaining level is the lowest level.

Figure 17:
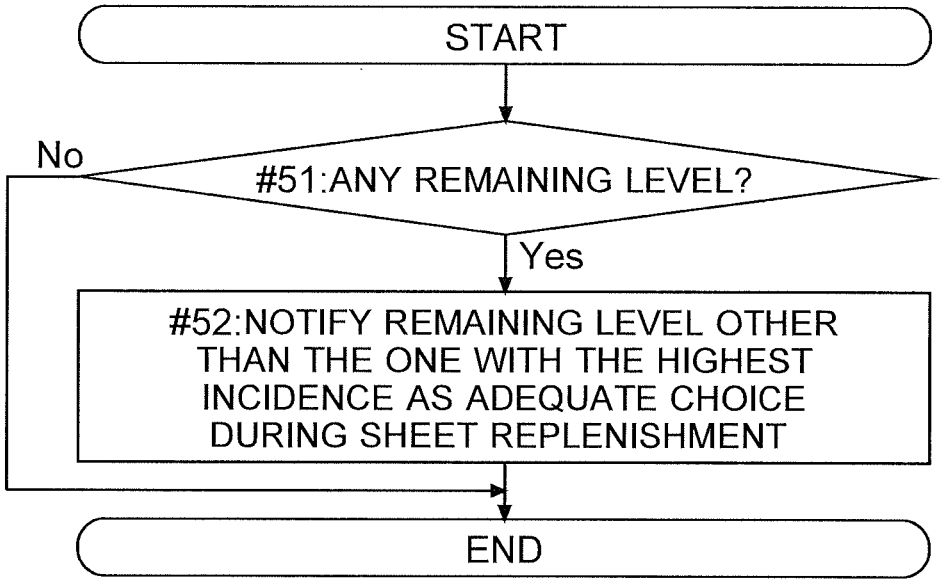
FIG. 17 is a diagram showing one example of adequate choice notification during sheet replenishment in the image forming apparatus according to the embodiment.

START in FIG. 17 is the time when, while the remaining level is at the lowest level, the adequate choice notification M5 is performed. The time point when the adequate choice notification M5 is performed can be appropriately determined. The time point when the adequate choice notification M5 is performed may be the time point when the controller 1 recognizes operation on the operation panel 3. The time point when the adequate choice notification M5 is performed may be the time point when the current state notification M0 is displayed. Or, it may be the time point when the controller 1 recognizes that the incidence at any remaining level is exceeding the first threshold value Th1. Or, the time point when the adequate choice notification M5 is performed may be the time point when, as a result of the main power being turned on, the image forming apparatus 100 completes starting up. Or, it may be the time point when, having recovered from a power saving mode, the image forming apparatus 100 enters an active mode (normal mode). The image forming apparatus 100 includes a plurality of sheet feeding portions 5. The controller 1 performs the procedure in the flow chart in FIG. 17 for each sheet feeding unit 5.

First, the controller 1 checks whether there is any remaining level at which the incidence exceeds the first threshold value Th1 (step #51). Here, the controller 1 may use the first threshold value Th1 (a prescribed fixed value) stored in the storage portion 2. Or, the controller 1 may determine the first threshold value Th1 for each remaining level (similarly as in step #24). In this case, the controller 1 decreases the first threshold value Th1 as the incidence increases. The controller 1 increases the first threshold value Th1 as the incidence decreases.

When there is no remaining levels at which the incidence exceeds the first threshold value Th1 (No in step #51), the controller 1 ends the procedure (END). When there is a remaining level at which the incidence exceeds the first threshold value Th1 (Yes in step #51), the controller 1 makes the notification portion notify, as an adequate level of sheet replenishment, a remaining level other than the one with the highest incidence (step #52). Then, the procedure ends (END). The controller 1 may notify, as a reference level, the remaining level at which the incidence is the lowest. The controller 1 may notify, as a reference level, only the remaining level at which the incidence is equal to or lower than the first threshold value Th1.

Figure 18:
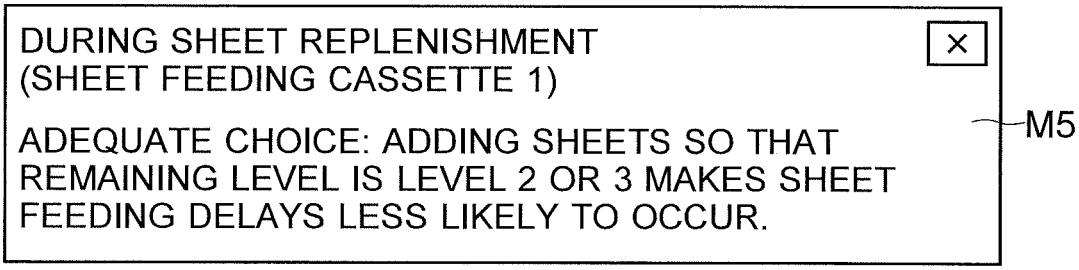
FIG. 18 is a diagram showing one example of an adequate choice notification according to the embodiment.

FIG. 18 shows one example of an adequate choice notification M5 displayed in step #52. The adequate choice notification M5 is a notification which notifies an adequate choice of the remaining level after a sheet replenishment. The controller 1 notifies the remaining level at which the incidence of sheet feeding delays is low as an adequate choice level. The controller 1 makes the display panel 31 display the adequate choice notification M5. The controller 1 can make the communication portion 6 notify (transmit) data for displaying the adequate choice notification M5 toward the computer 200 of an administrator. In that case, the adequate choice notification M5 is displayed on the display of the computer 200. FIG. 18 shows an example of notifying that it is preferable to choose the remaining level 2 or 3 after sheet replenishment. Operating the cross-marked button can close the adequate choice notification M5. The adequate choice notification M5 may be displayed simultaneously with a notification of any other kind.

Modified Examples

The above embodiment deals with an example where the image forming apparatus 100 counts the required time and calculates the incidence for each remaining level based on the required time in the image forming apparatus 100 itself. However, the controller 1 may use data acquired from another image forming apparatus to calculate the incidence for each remaining level.

In the case where data acquired from another image forming apparatus is used, this other image forming apparatus (an acquisition target apparatus 101) from which data (incidence) is acquired is previously determined. The acquisition target apparatus 101 is another image forming apparatus. The acquisition target apparatus 101 is an image forming apparatus (see FIG. 1) that can communicate with the communication portion 6 in the image forming apparatus 100 via a network. For example, the operation panel 3 accepts setting for determining the acquisition target apparatus 101 among the image forming apparatuses connected to a network. For example, an image forming apparatus 100 of the same model, or an image forming apparatus 100 with a sheet feeding unit 5 having the same structure (that is, an apparatus in the same product line) can be determined as the acquisition target apparatus 101. The acquisition target apparatus 101 can be one apparatus or a plurality of apparatuses.

When determining the incidence for each remaining level using data acquired from another image forming apparatus, the controller 1 makes the communication portion 6 communicate with the acquisition target apparatus 101. The controller 1 calculates the incidence for each remaining level at a prescribed cycle. The cycle can be, for example, 24 hours. The cycle is not limited to 24 hours.

The controller 1 makes the communication portion 6 acquire the incidence for each remaining level from the acquisition target apparatus 101. After the incidence is acquired, the controller 1 calculates the average value of the incidence in the image forming apparatus 100 itself and the incidence in the acquisition target apparatus 101 for each remaining level. When the structure of the sheet feeding unit 5 is the same or similar, the incidences for each remaining level are often close. For each remaining level, an incidence with less deviation can be determined. The controller 1 deals with the calculated average value for each remaining level as the incidence of the image forming apparatus 100 itself. In that case, the controller 1 makes the storage portion 2 store the incidence based on the average as notification data D1. Based on the incidence based on the average, the controller 1 performs the procedure in the flow charts in FIGS. 10, 12, 15, and 17.

In this way, the image forming apparatus 100 according to the embodiment includes the notification portion (display panel 31 and communication portion 6), the sheet feeding cassette 51, the sheet feeding rotary member 52 (sheet feeding roller 52*a*, the separating roller pair 52*b*), the sheet feeding sensor 8, the remaining quantity sensor 7, the storage portion 2, and the controller 1. The notification portion performs notification. The sheet feeding cassette 51 includes the placing plate 53 on which sheets are set. The sheet feeding rotary member 52 is provided above the sheet feeding cassette 51, and feeds sheets by rotating. The sheet feeding sensor 8 is provided on the downstream side of the sheet feeding rotary member 52 in the sheet conveying direction and senses the arrival and the passage of sheets. The remaining quantity sensor 7 is for sensing the remaining quantity of sheets in the sheet feeding cassette 51. The storage portion 2 stores notification data D1. The controller 1 recognizes the remaining level of sheets in the sheet feeding cassette 51 based on the output of the remaining quantity sensor 7. The controller 1 raises the placing plate 53 according to the remaining quantity of sheets such that the sheet feeding rotary member 52 and the sheets make contact with each other. The controller 1 counts the required time after the sheet feeding rotary member 52 starts to rotate until the sheet feeding sensor 8 senses the tip end of a sheet. The controller 1 judges whether a sheet feeding delay has occurred based on the required time. The controller 1 makes the storage portion 2 store the cumulative number of fed sheets for each remaining level and the number of sheets whose sheet feeding has delayed for each remaining level as notification data D1. The controller 1 calculates the incidence of sheet feeding delays for each remaining level based on notification data D1. The controller 1 makes the notification portion notify the remaining level at which the incidence exceeds the first threshold value Th1.

With this, the incidence of sheet feeding delays for each sheet remaining level can be calculated. It is possible to notify a user of a remaining level at which sheet feeding delays and non-feed jams are likely to occur and a remaining level at which sheet feeding delays and non-feed jams are unlikely to occur. Based on the notification, the user can adjust the quantity of sheets in the sheet feeding cassette 51. With the notification, it is possible to make the user take a measure to reduce sheet feeding delays and non-feed jams. For example, the user can maintain the remaining level of sheets at a level at which sheet feeding delays and non-feed jams are less likely to occur. As a result, the incidence of sheet feeding delays and non-feed jams before the life of the sheet feeding rotary member 52 ends can be reduced.

The controller 1 recognizes the current remaining level based on the output of the remaining quantity sensor 7. When the incidence at the current remaining level exceeds the first threshold value Th1, the controller 1 checks whether there is any remaining level at which the incidence is equal to or lower than the first threshold value Th1. When there is a remaining level at which the incidence is equal to or lower than the first threshold value Th1, the controller 1 makes the notification portion notify the remaining level at which the incidence is equal to or lower than the first threshold value Th1. With this, it is possible to notify a user of the remaining level at which the incidence of sheet feeding delays is low. Based on this notification, the user can take a measure by increasing or reducing the quantity of sheets in the sheet feeding cassette 51 such that the remaining level equals the notified level. By increasing or reducing the quantity of sheets, the incidence of sheet feeding delays and non-feed jams before the life of the sheet feeding rotary member 52 ends can be reduced.

The controller 1, when there is no remaining level at which the incidence is equal to or lower than the first threshold value Th1, makes the notification portion notify the remaining level at which the incidence is lower than at the current remaining level. With this, it is possible to notify a user of the remaining level at which sheet feeding delays are less likely to occur than at the current remaining level. Based on this notification, the user can take a measure by increasing or reducing the quantity of sheets in the sheet feeding cassette 51 such that the remaining level equals the notified remaining level. By increasing or reducing the quantity of sheets, even when wear of the sheet feeding rotary member 52 advances to some extent, the incidence of sheet feeding delays and non-feed jams can be reduced.

When there is no remaining level at which the incidence is equal to or lower than the first threshold value Th1, the controller 1 may make the notification portion notify the remaining level with the lowest incidence. With this, it is possible to notify a user of the remaining level at which sheet feeding delays are currently most unlikely to occur. Based on this notification, the user can take a measure by increasing or reducing the quantity of sheets in the sheet feeding cassette 51 such that the remaining level equals the notified remaining level. It is possible to minimize the incidence of sheet feeding delays and non-feed jams.

When the incidence of the next remaining level, that is, the remaining level one level lower than the current remaining level, exceeds the first threshold value Th1, the controller 1 makes the notification portion notify the remaining level at which the incidence is lower than the next remaining level. With this, it is possible to perform notification in preparation for when the remaining level lowers by one level in the future due to sheet consumption. It is possible to notify a user in advance of the remaining level at which sheet feeding delays are unlikely to occur at the updated remaining level. It is possible to notify, before the remaining quantity lowers, the remaining level of sheets to be set in the sheet feeding cassette 51 in the future.

When there is a remaining level at which the incidence exceeds the first threshold value Th1, and the current remaining level is the lowest level, the controller 1 makes the notification portion notify, as an adequate level of sheet replenishment, a remaining level other than the one with the highest incidence. With this, it is possible to notify a user in advance of the remaining level at which, when sheets run out, the incidence of sheet feeding delays is low. It is possible to notify, before sheets run out, to notify the remaining level of the sheets to be set in the sheet feeding cassette 51 in the future.

The controller 1 determines the first threshold value Th1 for each remaining level. The controller 1 decreases the first threshold value Th1 as the incidence increases. The controller 1 increases the first threshold value Th1 as the incidence decreases. With this, at the remaining level with a high incidence of sheet feeding delays, notification is more likely to be performed. It is possible to increase the frequency of notification to reduce sheet feeding delays and non-feed jams.

The image forming apparatus 100 includes a plurality of sheet feeding cassettes 51. The sheet feeding rotary member 52 and the remaining quantity sensor 7 are provided for each sheet feeding cassette 51. The controller 1 recognizes the remaining level for each sheet feeding cassette 51. The controller 1 makes the storage portion 2 store notification data D1 for each sheet feeding cassette 51. In the case a plurality of sheet feeding cassettes 51 store sheets of the same size, when the incidence at the current remaining level in one of the cassettes having sheets of the same size or the incidences in all the cassettes having sheets of the same size exceeds the first threshold value Th1, the controller 1 may make the notification portion notify a proposal notification M3 that proposes movement of the sheets between the cassettes with sheets of the same size. With this, it is possible to propose movement of the sheets between the sheet feeding cassettes 51 such that the incidence of sheet feeding delays in the sheet feeding cassette 51 lowers.

When the incidence exceeds a prescribed second threshold value Th2, the controller 1 makes the notification portion notify necessity for replacement of the sheet feeding rotary member 52. The second threshold value Th2 is larger than the first threshold value Th1. With this, when the incidence of sheet feeding delay increases, it is possible to notify necessity for replacement of the sheet feeding rotary member 52. It is possible to recommend a user to replace the sheet feeding rotary member 52 whose life has ended or is about to end.

As described in the modified examples, image forming apparatuses 100 with similar structures have similar tendencies in the incidence of sheet feeding delays for each remaining level of sheets. Thus, the image forming apparatus 100 includes the communication portion 6 that communicates with the acquisition target apparatus 101. The acquisition target apparatus 101 is another image forming apparatus that is previously determined as a target from which the incidence is acquired. The controller 1 makes the communication portion 6 acquire the incidence for each remaining level from the acquisition target apparatus 101. The controller 1 calculates the average value of the incidence in the image forming apparatus 100 itself and the incidence in the acquisition target apparatus 101 for each remaining level. The controller 1 takes the calculated average value for each remaining level as the incidence of the image forming apparatus 100 itself.

With this, the average value of the incidences for each remaining level in a plurality of image forming apparatuses can be taken as the incidence of sheet feeding delays in the image forming apparatus 100 itself. In some cases, taking an average helps determine the accurate incidence of sheet feeding delays without deviation.

The embodiment described above is in no way meant to limit the present disclosure, which thus allows for many modifications and variations within the spirit of the present disclosure.

What is claimed is:

1. An image forming apparatus, comprising:

a notification portion which performs notification;

a sheet feeding cassette which includes a placing plate on which sheets are set;

a sheet feeding rotary member which is provided above the sheet feeding cassette and which rotates to feed sheets;

a sheet feeding sensor which is provided on a downstream side of the sheet feeding rotary member in a sheet conveying direction and which senses arrival and passage of sheets;

a remaining quantity sensor which senses a remaining quantity of sheets in the sheet feeding cassette;

a storage portion which stores notification data; and a controller which recognizes a remaining level of sheets in the sheet feeding cassette based on an output of the remaining quantity sensor, raises the placing plate according to the remaining quantity of sheets such that the sheet feeding rotary member and the sheets make contact with each other, counts a required time after the sheet feeding rotary member starts to rotate until the sheet feeding sensor senses a tip end of a sheet, judges whether a sheet feeding delay has occurred based on the required time, makes the storage portion store a cumulative number of fed sheets for each remaining level and a number of sheets whose sheet feeding has delayed for each remaining level as the notification data, calculates an incidence of sheet feeding delays for each remaining level based on the notification data, and makes the notification portion notify the remaining level at which the incidence exceeds a first threshold value.

2. The image forming apparatus according to claim 1, wherein the controller recognizes the current remaining level based on the output of the remaining quantity sensor, when the incidence at the current remaining level exceeds the first threshold value, the controller checks whether there is any remaining level at which the incidence is equal to or lower than the first threshold value, and when there is a remaining level at which the incidence is equal to or lower than the first threshold value, the controller makes the notification portion notify the remaining level at which the incidence is equal to or lower than the first threshold value.

3. The image forming apparatus according to claim 2, wherein when there is no remaining level at which the incidence is equal to or lower than the first threshold value, the controller makes the notification portion notify the remaining level at which the incidence is lower than at the current remaining level.

4. The image forming apparatus according to claim 2, wherein when there is no remaining level at which the incidence is equal to or lower than the first threshold value, the controller makes the notification portion notify the remaining level at which the incidence is the lowest.

5. The image forming apparatus according to claim 1, wherein when the incidence of a next remaining level, which is the remaining level one level lower than the current remaining level, exceeds the first threshold value, the controller makes the notification portion notify the remaining level at which the incidence is lower than at the next remaining level.

6. The image forming apparatus according to claim 1, wherein when there is the remaining level at which the incidence exceeds the first threshold value and the current remaining level is a lowest level, the controller makes the notification portion notify, as an adequate level of sheet replenishment, a remaining level other than the one with the highest incidence.

7. The image forming apparatus according to claim 1, wherein the controller determines the first threshold value for each remaining level, decreases the first threshold value as the incidence increases, and increases the first threshold value as the incidence decreases.

8. The image forming apparatus according to claim 1, further comprising;

a communication portion which communicates with an acquisition target apparatus, wherein the acquisition target apparatus is another image forming apparatus which is previously determined as a target from which the incidence is acquired, the controller makes the communication portion acquire the incidence for each remaining level from the acquisition target apparatus, the controller calculates an average value of the incidence in the image forming apparatus itself and the incidence in the acquisition target apparatus for each remaining level, and the controller takes the calculated average value for each remaining level as the incidence of the image forming apparatus itself.

9. The image forming apparatus according to claim 1, further comprising;

a plurality of sheet feeding cassettes, wherein the sheet feeding rotary member and the remaining quantity sensor are provided for each sheet feeding cassette, the controller recognizes the remaining level for each sheet feeding cassette, makes the storage portion store the notification data for each sheet feeding cassette, and makes the notification portion notify a proposal notification that proposes movement of sheets between the cassettes with sheets of the same size in the case a plurality of sheet feeding cassettes store sheets of a same size when the incidence at the current remaining level in one of the cassettes having sheets of the same size or in all the cassettes having sheets of the same size exceeds the first threshold value.

10. The image forming apparatus according to claim 1, wherein when the incidence exceeds a prescribed second threshold value, the controller makes the notification portion notify necessity for replacement of the sheet feeding rotary member, and the second threshold value is larger than the first threshold value.

11. The image forming apparatus according to claim 1, wherein the remaining quantity sensor includes a first sensor and a second sensor, and the controller recognizes the remaining level of sheets based on a combination of output values from the first sensor and the second sensor.

12. A method for controlling an image forming apparatus, the method comprising:

setting sheets on a placing plate included in a sheet feeding cassette;

providing a sheet feeding rotary member above the sheet feeding cassette which rotates to feed sheets;

providing a sheet feeding sensor for sensing arrival and passage of sheets on a downstream side of the sheet feeding rotary member in a sheet conveying direction;

sensing a remaining quantity of sheets in the sheet feeding cassette;

storing notification data;

recognizing a remaining level of sheets in the sheet feeding cassette based on an output of the remaining quantity sensor;

raising the placing plate according to a remaining quantity of sheets such that the sheet feeding rotary member and sheets make contact with each other;

counting a required time after the sheet feeding rotary member starts to rotate until the sheet feeding sensor senses a tip end of a sheet;

judging whether a sheet feeding delay has occurred based on the required time;

storing a cumulative number of fed sheets for each remaining level and a number of sheets whose sheet feeding has delayed for each remaining level as the notification data;

calculating an incidence of sheet feeding delays for each remaining level based on the notification data; and notifying the remaining level at which the incidence exceeds the first threshold value.

* * * * *